US005799733A

United States Patent [19]

Ringgenberg et al.

[11] Patent Number: 5,799,733

[45] Date of Patent: Sep. 1, 1998

[54] EARLY EVALUATION SYSTEM WITH PUMP AND METHOD OF SERVICING A WELL

[75] Inventors: Paul David Ringgenberg, Carrolton; Neal Gregory Skinner, Lewisville; Curtis Edgar Wendler, Carrollton, all of Tex.; Roger Lynn Schultz, Stillwater, Okla.; Robert W. Srubar, Katy; Margaret Cowsar Waid, Houston, both of Tex.

[73] Assignee: Halliburton Energy Services, Inc., Dallas, Tex.

[21] Appl. No.: 941,883

[22] Filed: Sep. 30, 1997

Related U.S. Application Data

[63] Continuation of Ser. No. 578,489, Dec. 26, 1995.

[51] Int. Cl.[6] ..... E21B 49/08

[52] U.S. Cl. ..... 166/264; 166/147; 166/106

[58] Field of Search ..... 166/264, 266, 166/271, 100, 250.07, 147, 106; 73/152.26, 152.51, 152.24

[56] References Cited

U.S. PATENT DOCUMENTS

| | | | |
|---|---|---|---|
| 1,899,497 | 2/1933 | Doherty . | |
| 2,125,159 | 7/1938 | Hanes | 166/1 |
| 2,222,829 | 11/1940 | Humason et al. | 166/1 |
| 2,280,785 | 4/1942 | Boynton | 166/11 |
| 2,392,683 | 1/1946 | McWhorter | 255/1.4 |
| 2,497,185 | 2/1950 | Reistle, Jr. | 166/1 |
| 2,677,790 | 5/1954 | Arps | 324/1 |
| 2,702,474 | 2/1955 | Johnston | 73/152 |
| 2,751,016 | 6/1956 | Watzlavick | 166/187 |
| 2,819,038 | 1/1958 | Eckel | 255/1.4 |
| 2,978,046 | 4/1961 | True | 175/233 |
| 3,103,811 | 9/1963 | Ayres et al. | 73/152 |
| 3,107,729 | 10/1963 | Barry et al. | 166/66 |
| 3,111,169 | 11/1963 | Hyde | 166/145 |
| 3,182,725 | 5/1965 | Moore | 166/65 |
| 3,279,249 | 10/1966 | Tocanne | 73/153 |
| 3,327,781 | 6/1967 | Nutter | 166/3 |
| 3,353,612 | 11/1967 | Bannister | 175/6 |
| 3,412,607 | 11/1968 | Jensen | 73/155 |
| 3,441,095 | 4/1969 | Youmans | 175/59 |

(List continued on next page.)

OTHER PUBLICATIONS

*Petroleum Engineer International*, Jun., 1987, article entitled "MWD Transmission Data Rates Can be Optimized" by Robert Desbrandes, Adam T. Bourgoyne, Jr., and Joseph A. Carter.

SPE Paper No. 17581—"Coiled Tubing in Horizontal Wells" by R. E. Cooper, Nov., 1988.

*Primary Examiner*—Frank Tsay

*Attorney, Agent, or Firm*—William M. Imwalle; Paul I. Herman; Neal R. Kennedy

[57] ABSTRACT

An early evaluation system with pump for servicing a well and taking fluid samples and measurements. In each of the embodiments, a formation pump is actuated to flow fluid from the well formation below a packer element engaged with the borehole into a sampling tube. Fluid samplers and recording instruments may be in communication with the sampling tube. In one embodiment, the pump is mechanically actuated by rotation of the tool string. In another embodiment, the pump is hydraulically actuated and has a hydraulic motor connected thereto. In this hydraulically acutated embodiment, fluid pumped down the tool string actuates the hydraulic motor and thereby further actuates the pump. Other pump embodiments are also disclosed. In still another embodiment, the apparatus may be incorporated into a drill string so that a drilling operation may be carried out and immediately followed by a fluid evaluation operation. In this latter embodiment, circulating valves disposed in the apparatus allow fluid to be pumped downwardly through the drill bit when in a first position and then allow fluid samples to be taken by actuation of the pump when in a second position after the packer elements are engaged. Methods of drilling and servicing a well and conducting a bubble point determination utilizing the apparatus are also disclosed.

79 Claims, 5 Drawing Sheets

U.S. PATENT DOCUMENTS

| | | | |
|---|---|---|---|
| 3,448,611 | 6/1969 | Lebourg | 73/151 |
| 3,459,264 | 8/1969 | Olson et al. | 166/250 |
| 3,500,911 | 3/1970 | Farley et al. | 166/250 |
| 3,577,781 | 5/1971 | Lebourg et al. | 73/152 |
| 3,577,783 | 5/1971 | Whitten et al. | 73/152 |
| 3,611,799 | 10/1971 | Davis | 73/155 |
| 3,780,575 | 12/1973 | Urbanosky | 73/152 |
| 3,850,240 | 11/1974 | Conover | 166/162 |
| 3,859,851 | 1/1975 | Urbanosky | 73/152.24 |
| 3,864,970 | 2/1975 | Bell | 73/155 |
| 3,876,003 | 4/1975 | Kisling, III | 166/250 |
| 3,895,520 | 7/1975 | Fertl | 73/152 |
| 3,964,556 | 6/1976 | Gearhart et al. | 175/45 |
| 3,969,937 | 7/1976 | Barrington et al. | 73/151 |
| 4,031,957 | 6/1977 | Sanford | 166/264 |
| 4,043,407 | 8/1977 | Wilkins | 175/50 |
| 4,142,594 | 3/1979 | Thompson et al. | 175/59 |
| 4,230,180 | 10/1980 | Patton et al. | 166/185 |
| 4,246,964 | 1/1981 | Brandell | 166/106 |
| 4,287,946 | 9/1981 | Brieger | 166/100 |
| 4,313,495 | 2/1982 | Brandell | 166/53 |
| 4,317,490 | 3/1982 | Milberger et al. | 175/20 |
| 4,339,948 | 7/1982 | Hallmark | 73/155 |
| 4,370,886 | 2/1983 | Smith, Jr. et al. | 73/153 |
| 4,392,376 | 7/1983 | Lagus et al. | 73/155 |
| 4,498,536 | 2/1985 | Ross et al. | 166/250 |
| 4,535,843 | 8/1985 | Jageler | 166/264 X |
| 4,550,392 | 10/1985 | Mumby | 367/82 |
| 4,566,535 | 1/1986 | Sanford | 166/113 |
| 4,573,532 | 3/1986 | Blake | 166/264 |
| 4,580,632 | 4/1986 | Reardon | 166/250 |
| 4,583,595 | 4/1986 | Czernichow et al. | 166/264 |
| 4,589,485 | 5/1986 | Wray | 166/250 |
| 4,597,439 | 7/1986 | Meek | 166/264 X |
| 4,635,717 | 1/1987 | Jageler | 166/250 |
| 4,729,430 | 3/1988 | White et al. | 166/106 |
| 4,745,802 | 5/1988 | Purfurst | 73/155 |
| 4,787,447 | 11/1988 | Christensen | 166/169 |
| 4,790,378 | 12/1988 | Montgomery et al. | 166/66 |
| 4,818,197 | 4/1989 | Mueller | 418/48 |
| 4,838,349 | 6/1989 | Berzin | 166/187 |
| 4,856,585 | 8/1989 | White et al. | 166/250 |
| 4,860,580 | 8/1989 | DuRocher | 73/155 |
| 4,866,607 | 9/1989 | Anderson et al. | 364/422 |
| 4,898,236 | 2/1990 | Sask | 166/65.1 |
| 4,903,765 | 2/1990 | Zunkel | 166/162 |
| 4,936,139 | 6/1990 | Zimmerman et al. | 73/152.26 |
| 4,955,438 | 9/1990 | Juergens et al. | 175/40 |
| 4,962,815 | 10/1990 | Schultz et al. | 166/387 |
| 5,008,664 | 4/1991 | More et al. | 340/854 |
| 5,058,674 | 10/1991 | Schultz et al. | 166/264 |
| 5,095,745 | 3/1992 | Desbrandes | 73/152 |
| 5,097,902 | 3/1992 | Clark | 166/187 |
| 5,105,881 | 4/1992 | Thoms et al. | 166/250 |
| 5,184,508 | 2/1993 | Desbrandes | 73/152 |
| 5,220,829 | 6/1993 | Manke et al. | 166/264 X |
| 5,240,072 | 8/1993 | Schultz et al. | 166/169 |
| 5,287,741 | 2/1994 | Schultz et al. | 73/155 |
| 5,329,811 | 7/1994 | Schultz et al. | 73/155 |
| 5,337,821 | 8/1994 | Peterson | 166/250 |
| 5,343,963 | 9/1994 | Bouldin et al. | 175/27 |
| 5,353,875 | 10/1994 | Schultz et al. | 166/297 |
| 5,361,839 | 11/1994 | Griffith et al. | 166/264 |
| 5,368,100 | 11/1994 | Lewandowski et al. | 166/264 |
| 5,540,280 | 7/1996 | Schultz et al. | 166/250.07 |
| 5,555,945 | 9/1996 | Schultz et al. | 175/50 |

EARLY EVALUATION SYSTEM WITH PUMP AND METHOD OF SERVICING A WELL

This application is a continuation of copending application Ser. No. 08/578,489 filed on Dec. 26, 1995.

BACKGROUND OF THE INVENTION

1. Field of the Invention

The present invention relates generally to methods and apparatus for servicing a well, and more particularly, to methods and apparatus for the early evaluation of a well after the borehole has been drilled and before casing has been cemented in the borehole wherein the apparatus utilizes a pump to move fluid therethrough.

2. Description of the Prior Art

During the drilling and completion of oil and gas wells, it is often necessary to test or evaluate the production capabilities of the well. This is typically done by isolating a subsurface formation or a portion of a zone of interest which is to be tested and subsequently flowing a sample of well fluid either into a sample chamber or up through a tubing string to the surface. Various data, such as pressure and temperature of the produced well fluids, may be monitored down hole to evaluate the long-term production characteristics of the formation.

One very commonly used well testing procedure is to first cement a casing in the borehole and then to perforate the casing adjacent zones of interest. Subsequently, the well is flow-tested through the perforations. Such flow tests are commonly performed with a drill stem test string which is a string of tubing located within the casing. The drill stem test string carries packers, tester valves, circulating valves and the like to control the flow of fluids through the drill stem test string.

Although drill stem testing of cased wells provides very good test data, it has the disadvantage that the well must first be cased before the test can be conducted. Also, better reservoir data can often be obtained immediately after the well is drilled and before the formation has been severely damaged by drilling fluids and the like.

For these reasons, it is often desired to evaluate the potential production capability of a well without incurring the cost and delay of casing the well. This has led to a number of attempts at developing a successful open-hole test which can be conducted in an uncased borehole.

One approach which has been used for open-hole testing is the use of a weight-set, open-hole compression packer on a drill stem test string. To operate a weight-set, open-hole compression packer, a solid surface must be provided against which the weight can be set. Historically, this is accomplished with a perforated anchor which sets down on the bottom. A disadvantage of the use of open-hole compression set type packers is that they can only be used adjacent to the bottom of the hole. Thus, it is necessary to immediately test a formation of interest after it has been drilled through. These types of packers are difficult to use when testing a subsurface formation located at a substantial height above the bottom of the hole. Also, this type of test string is undesirable for use offshore because the pipe string can become stuck in the open borehole due to differential pressures between the borehole and various formations. As will be understood by those skilled in the art, when the pipe string is fixed and is no longer rotating, portions of the pipe string will lay against the side of the borehole and sometimes a differential pressure situation will be encountered wherein the pipe string becomes very tightly stuck against the sidewall of the borehole. This is an especially dangerous problem when the flow control valves of the test string are operated by manipulation of the test string. In these situations, if the test string becomes stuck, it may be impossible to control the flow of fluid through the test string.

Another prior art procedure for open-hole testing is shown in U.S. Pat. No. 4,246,964 to Brandell, assigned to the assignee of the present invention. The Brandell patent is representative of a system marketed by the assignee of the present invention as the Halliburton Hydroflate system. The Hydroflate system utilizes a pair of spaced inflatable packers which are inflated by a downhole pump. Well fluids can then flow up the pipe string which supports the packers in the well. This system still has the disadvantage that the pipe string is subject to differential sticking in the open borehole.

A similar procedure may be carried out using a straddle packer with compressible packer elements. Use of this device has the additional disadvantage of requiring that the packer be supported on the bottom of the hole or that a sidewall anchor is required.

Another approach to open-hole testing is through the use of pad-type wireline testers which simply press a small resilient pad against the sidewall of the borehole and take a very small unidirectional sample through an orifice in the pad. An example of such a pad-type tester is shown in U.S. Pat. No. 3,577,781 to Lebourg. The primary disadvantage of pad-type testers is that they take a very small unidirectional sample which is often not truly representative of the formation and which provides very little data on the production characteristics of the formation. It is also sometimes difficult to seal the pad. When the pad does seal, it is subject to differential sticking and sometimes the tool may be damaged when it is removed.

Another shortcoming of wireline formation testers which use a pad is that the pad is relatively small. If the permeability of the formation is high, hydrostatic pressure can be transmitted through the formation between the outside of the pad and the center of the pad where the pressure measurement is being made in a very short period of time. This will result in measuring hydrostatic pressure soon after attempting to measure formation pressure. This may limit the effectiveness of wireline formation testers in some conditions.

Another approach which has been proposed in various forms, but which to the best of our knowledge has never been successfully commercialized, is to provide an outer tubing string with a packer which can be set in a borehole, in combination with a wireline-run surge chamber which is run into engagement with the outer string so as to take a sample from below the packer. One example of such a system is shown in U.S. Pat. No. 3,111,169 to Hyde, and assigned to the assignee of the present invention. Other examples of such devices are seen in U.S. Pat. No. 2,497,185 to Reistle, Jr.; U.S. Pat. No. 3,107,729 to Barry et al.; U.S. Patent No. 3,327,781 to Nutter; U.S. Pat. No. 3,850,240 to Conover; and U.S. Pat. No. 3,441,095 to Youmans.

A number of improvements in open-hole testing systems of the type generally proposed in U.S. Pat. No. 3,111,169 to Hyde are shown in U.S. patent application Ser. No. 08/292,131, assigned to the assignee of the present invention. In a first aspect of the invention of Ser. No. 08/292,131, a system is provided including an outer tubing string having an inflatable packer, a communication passage disposed through the tubing string below the packer, an inflation passage communicated with the inflatable element of the packer, and an inflation valve controlling flow of inflation fluid through the inflation passage. The inflation valve is constructed so that the opening and closing of the inflation valve is controlled by surface manipulation of the outer tubing string. Thus, the inflatable packer can be set in the well simply by manipulation of the outer tubing string and applying fluid pressure to the tubing string without running an inner well tool into the tubing string. After the packer has been set, an inner well tool, such as a surge chamber, may be run into and engaged with the outer tubing string to place the inner well tool in fluid communication with a subsurface formation through the communication passage. There is also an embodiment with a straddle packer having upper and lower packer elements which are engaged on opposite sides of the formation.

In another aspect of this prior invention, the well fluid samples are collected by running an inner tubing string, preferably an inner coiled tubing string, into the previously described outer tubing string. The coiled tubing string is engaged with the outer tubing string, and the bore of the coiled tubing string is communicated with a subsurface formation through the circulation passage defined in the outer tubing string. Then well fluid from the subsurface is flowed through the communication passage and up the coiled tubing string. Such a coiled tubing string may include various valves for control of fluid flow therethrough.

This prior invention may also be used to treat a subsurface formation. Instead of running a surge chamber to collect a sample of fluid, a pressure injection canister may be run into and engaged with the outer tubing string. The pressurized injection canister is communicated with the subsurface formation through the circulation passage. A treatment fluid such as acid can then be injected into the subsurface formation.

The present invention presents improvements on the prior art by providing a sampling tube with multiple, independently activated samplers in communication therewith. Electronic instruments may also be placed in communication with the sampling tube to measure and/or record pressure, temperature, fluid resistivity, and other fluid properties. A formation pump is preferably located above the sampling tube and is used to draw fluid through the tube. The pump may be operated by a variety of means.

Typical tests conducted with a drill string test string are known as draw-down and build-up tests. For the "draw-down" portion of the test, a tester valve in the drill stem test string is opened, and the well is allowed to flow up through the drill string until the formation pressure is drawn down to a minimum level. For the "build-up" portion of the test, the tester valve is closed, and the formation pressure is allowed to build up below the tester valve to a maximum pressure. Such draw-down and build-up tests may take many days to complete.

There is a need for quick, reliable testing procedures which can be conducted at an early stage in the drilling of a well before casing has been set. This is desirable for a number of reasons. First, if the well is a commercially unsuccessful well, then the cost of casing the well can be avoided or minimized. Second, it is known that damage begins occurring to a subsurface producing zone or formation as soon as it is intersected by the drilled wellbore. Thus, it is desirable to conduct testing at as early a stage as possible.

While techniques and systems have been developed for testing open, uncased wellbores, it is often considered undesirable to flow test an open-hole well through a drill stem test string from the standpoint of safety considerations.

One technique that has been used is to pull the drill pipe out of the wellbore when it is desired to test a subterranean zone or formation penetrated by the wellbore and to then run special test string into the well for testing the zone or formation. This, of course, involves the time and cost of pulling and running pipe and is disadvantageous from that standpoint.

A prior invention which provides integrated drilling and production evaluation systems and methods is disclosed in U.S. patent application Ser. No. 08/292,341, assigned to the assignee of the present invention. These methods and systems allow a variety of tests to be conducted during the drilling process including production flow tests, production fluid sampling, determining the subsurface zone or formation pressure, temperature and other conditions, etc.

The integrated well drilling and evaluation systems of this prior invention basically comprise a drill string, a drill bit carried on a lower end of the drill string for drilling a wellbore, a logging while drilling instrument included in the drill string for generating data indicative of the hydrocarbon productive nature of subsurface zones and formations intersected by the wellbore so that a zone or formation of interest may be identified without removing the drill string from the wellbore, a packer carried on the drill string above the drill bit for sealing the zone or formation of interest between the drill string and the wellbore, and a testing means included in the drill string which provides a valve for isolating and testing the zone or formation of interest, whereby the well can be drilled, logged and tested without removing the drill string from the wellbore.

In one embodiment of the present invention, the sampling chamber and formation pump are included in the drill string. Upper and lower circulation control valves allow the fluid to be pumped downwardly through the drill bit during a drilling operation and then shut off from the drill bit and opened between packers on the drill string so that a formation pump in the drill string may be actuated to flow formation fluid through a chamber containing samplers and instrumentation.

SUMMARY OF THE INVENTION

The purpose of the early evaluation system is to measure formation pressure, obtain a fluid sample and measure fluid properties during the sampling process to verify that the sample is representative of formation fluid. These operations can be performed at several depths, on one trip of the drill pipe, in an open borehole, before the well is cased. This information is important to well operators because knowledge of formation pressures and obtaining representative formation fluid samples are key to making the decision whether to plug and abandon a well, or to case the well and spend additional resources on it. In the present invention, a pump is utilized to flow fluid into a sampling chamber where the samples may be obtained and the fluid properties measured.

The early evaluation system of the present invention includes an apparatus for use in servicing a well having an uncased borehole intersecting a subsurface zone of interest. The apparatus comprises an outer tubing string, a housing adjacent to the outer tubing string and defining a sampling tube therein, a packer adjacent the housing and adapted for sealing the borehole on a side of the formation, and a formation pump disposed in the housing for flowing fluids from the formation through the sampling tube. Preferably, the packer is an inflatable packer. In one embodiment, the packer is a straddle packer having a pair of inflatable packer elements for sealing the wellbore on opposite sides of the formation. An equalizing means is provided for equalizing pressure on opposite sides of the packer elements when the straddle packer is engaged with the wellbore.

In one embodiment, the pump is mechanically actuated. The pump may be a progressive cavity pump having a shaft extending from a rotor thereof. The shaft is connected to the outer tubing string, and the outer tubing string is rotated with respect to the housing to actuate the pump. Bearing means may be provided between the outer tubing string and the housing to facilitate rotation. The pump may also be a reciprocating pump comprising a cylinder portion forming part of the housing and a plunger portion slidably disposed in the cylinder portion and connected to the outer tubing string. In this reciprocating embodiment, the outer tubing string is reciprocated with respect to the cylinder portion to actuate the pump. This reciprocating configuration might be reversed with the cylinder being connected to the tubing string and the plunger forming a part of the housing so that the cylinder portion is reciprocated with respect to the plunger portion. In another mechanically actuated pump embodiment, the pump may be driven by an electric motor. Other mechanical configurations may also be used.

In other embodiments of the invention, the pump is hydraulically actuated. In these embodiments, the apparatus further comprises a hydraulic motor connected to the pump, and the hydraulic motor is actuated by pumping fluid down through the outer tubing string, thereby activating the pump. The hydraulic motor may also be a progressive cavity device.

The apparatus preferably comprises a plurality of fluid samplers in communication with the sampling tube so that individual fluid samples may be taken and retained. Also, recording and measuring instruments may be in communication with the sampling tube whereby fluid characteristics of the formation may be measured and retained.

The apparatus may further comprise a telemetry system disposed in the housing whereby measured fluid data from the apparatus may be sent to the surface in real time while circulating fluid.

In a further embodiment of the apparatus, a longitudinal passage is defined through the pump and packer. A portion of this longitudinal passage may be formed by the sampling tube. A sampling port is defined in the packer and is in communication with the formation when the packer is engaged with the wellbore. A drill bit is connected to a lower end of the packer. This embodiment preferably further comprises an upper circulating valve having a first position wherein the outer tubing string is in communication with the longitudinal passage and a second position wherein the outer tubing string is isolated from the longitudinal passage, and a lower circulating valve having a first position wherein the sampling tube is in communication with the drill bit and isolated from the sampling port and a second position wherein the sampling tube is in communication with the sampling port and isolated from the drill bit. When the upper and lower circulating valves are in the first positions thereof, drilling fluid pumped down the outer tubing string is discharged adjacent to the drill bit so that drilling operations may be carried out. After drilling, the upper and lower circulating valves may be actuated to the second positions thereof, and the pump is then actuated for flowing fluid from the formation fluid through the sampling port into the sampling tube and to the samplers wherein fluid samples and measurements may be taken as previously described.

The present invention also includes a method of servicing a well having an uncased borehole intersecting a subsurface zone or formation of interest. The method comprises the steps of running an evaluation tool into the well wherein the evaluation tool comprises an outer tubing string, a housing adjacent to the outer tubing string and having a sampling tube therein, a packer connected to the housing, a communication passage communicating the sampling tube with a borehole below the packer, and a formation pump in communication with the sampling tube. In a preferred embodiment, the packer has an inflatable packer element, and the evaluation tool further comprises an inflation passage communicating the inflatable element with an interior of the outer tubing string, and an inflation valve having an open position wherein the inflation passage is open and having a closed position wherein the inflation passage is closed.

The method further comprises the steps of setting the packer in the borehole above the subsurface zone or formation and actuating the pump so that fluid is flowed from the borehole below the packer through the communication passage and sampling tube.

When the packer is an inflatable packer, the step of setting the packer may include inflating the inflatable element with an inflation valve in the open position thereof by increasing fluid pressure in the interior of the outer tubing string, after which the inflation valve is closed to maintain the packer in the borehole. The step of actuating the pump is carried out after closing the inflation valve. In an embodiment wherein the packer is a retrievable inflatable straddle packer having upper and lower packer elements, the inflation step includes setting the upper and lower packer elements above and below the subsurface zone or formation, respectively.

The method may further comprise the step of trapping a fluid sample in a sampler in communication with the sampling tube and repeating the pumping and trapping steps as necessary to trap additional well fluid samples. The pump does not pump fluid into the sampler. Rather, the pump is used to cause flow from the formation or zone of interest so that the fluid reaches the sampler. Actuation of the sampler itself draws fluid into the sampler.

In an embodiment where the pump is mechanically actuated, the pumping step may comprise rotating or reciprocating the outer tubing string with respect to the housing and thereby actuating the pump. In an alternate mechanically actuated embodiment, the pumping step may comprise energizing an electric motor to drive the pump.

In an embodiment wherein the pump is hydraulically actuated, the evaluation tool further comprises a hydraulic motor connected to the pump, and the pumping step comprises pumping fluid down the outer tubing string to activate or energize the hydraulic motor and further actuate the pump. This embodiment may further comprise exhausting fluid discharged from the motor and pump into a well annulus adjacent to the evaluation tool.

The present invention may also be said to include a method of drilling and servicing a well comprising the steps of positioning a drill string in the well, wherein the drill string comprises a drill bit, a packer connected to the drill bit with the packer defining a sampling port therein, a housing attached to the packer and having a sampling tube therein, a formation pump disposed in the housing and in communication with the sampling tube, and an outer tubing string disposed above the housing. In one preferred embodiment, the drill string may further comprise a first circulating valve having a first position wherein the sampling tube is in communication with the drill bit and isolated from the sampling port and a second position wherein the sampling tube is in communication with the sampling port and isolated from the drill bit, and a second circulating valve having a first position wherein the outer tubing string is in communication with the sampling tube and a second position wherein the outer tubing string is isolated from the sampling tube.

This method further comprises the steps of: drilling a borehole deeper in the well by rotation of the drill string such that the borehole intersects a subsurface zone or formation of interest; during drilling, circulating fluid down the outer tubing string to the drill bit; stopping rotation of the drill string; actuating the packer into sealing engagement with the subsurface zone or formation; and actuating the pump so that fluid is flowed from the subsurface zone or formation through the sampling port into the sampling tube. The method may further comprise the step of trapping a fluid sample in a sampler in communication with the sampling tube and repeating the pumping and trapping steps as desired to trap additional well fluid samples.

In an embodiment where the pump is hydraulically actuated, the drill string further comprises a hydraulic motor connected to the pump, and the pumping step comprises pumping fluid down the outer tubing string to activate the hydraulic motor and thereby actuate the pump when the first and second circulating valves are in the second positions thereof. This embodiment may further comprise exhausting fluid discharged from the motor and the pump into the well annulus adjacent to the drill string.

The method of drilling and servicing may also comprise the steps of disengaging the packer from sealing engagement, and repeating the other steps as desired.

Any of the methods of the present invention may also comprise the steps of recording a fluid characteristic of fluid flowed into the sampling chamber by means of a recorder disposed in the sampling chamber. Any of the methods may additionally comprise transmitting fluid data from a telemetry system positioned in the evaluation tool or drill string.

The methods of the present invention may further comprise the steps of running an inner well tool into the outer tubing string, and engaging the inner well tool with the outer tubing string, thereby placing the inner well tool in fluid communication with the subsurface zone or formation through the communication passage or sampling port. After this step, the method may further comprise flowing a fluid sample from the subsurface zone or formation through the sampling port and sampling tube to the inner well tool and/or stimulating the well by flowing fluid from the inner well tool through the sampling tube and sampling port to the subsurface zone or formation.

The present invention also includes a method of servicing a well and performing a bubble point determination in a wellbore intersecting a subsurface zone or formation of interest. In this method, an evaluation tool is run into the well. The evaluation tool comprises an outer tubing string, a housing adjacent to the outer tubing string and having a sampling tube therein, a valve disposed in the sampling tube, a communication passage communicating the sampling tube with the wellbore, and a formation pump in communication with the sampling tube. The method further comprises the steps of actuating the pump so that fluid is flowed from the zone into the wellbore and through the communication passage and sampling tube, closing the valve and then actuating the pump to reduce the pressure of fluid between the pump and the valve. This latter step preferably comprises reducing the pressure until the pressure drops below the bubble point of oil contained in the fluid such that a phase change occurs as gas breaks out of solution.

In this method of performing a bubble point determination, the evaluation tool may further comprise a pressure and/or temperature measuring instrument in communication with the sampling tube, and the method may further comprise using such instruments to detect the pressure and/or temperature at which the phase change occurs.

Numerous objects and advantages of the invention will become apparent as the following detailed description of the preferred embodiments is read in conjunction with the drawings which illustrate such embodiments.

BRIEF DESCRIPTION OF THE DRAWINGS

In FIG. 1A, this first embodiment is shown as it is run into the wellbore, and FIG. 1B illustrates the apparatus in operation with the packers inflated.

FIG. 2A illustrates this embodiment as it is run into the wellbore, and FIG. 2B shows it in operation.

FIG. 3A illustrates this embodiment as it is used as a drill string to drill the wellbore, and FIG. 3B illustrates the apparatus in operation during a testing phase.

DETAILED DESCRIPTION OF THE PREFERRED EMBODIMENTS

Figures 1A, 1B:
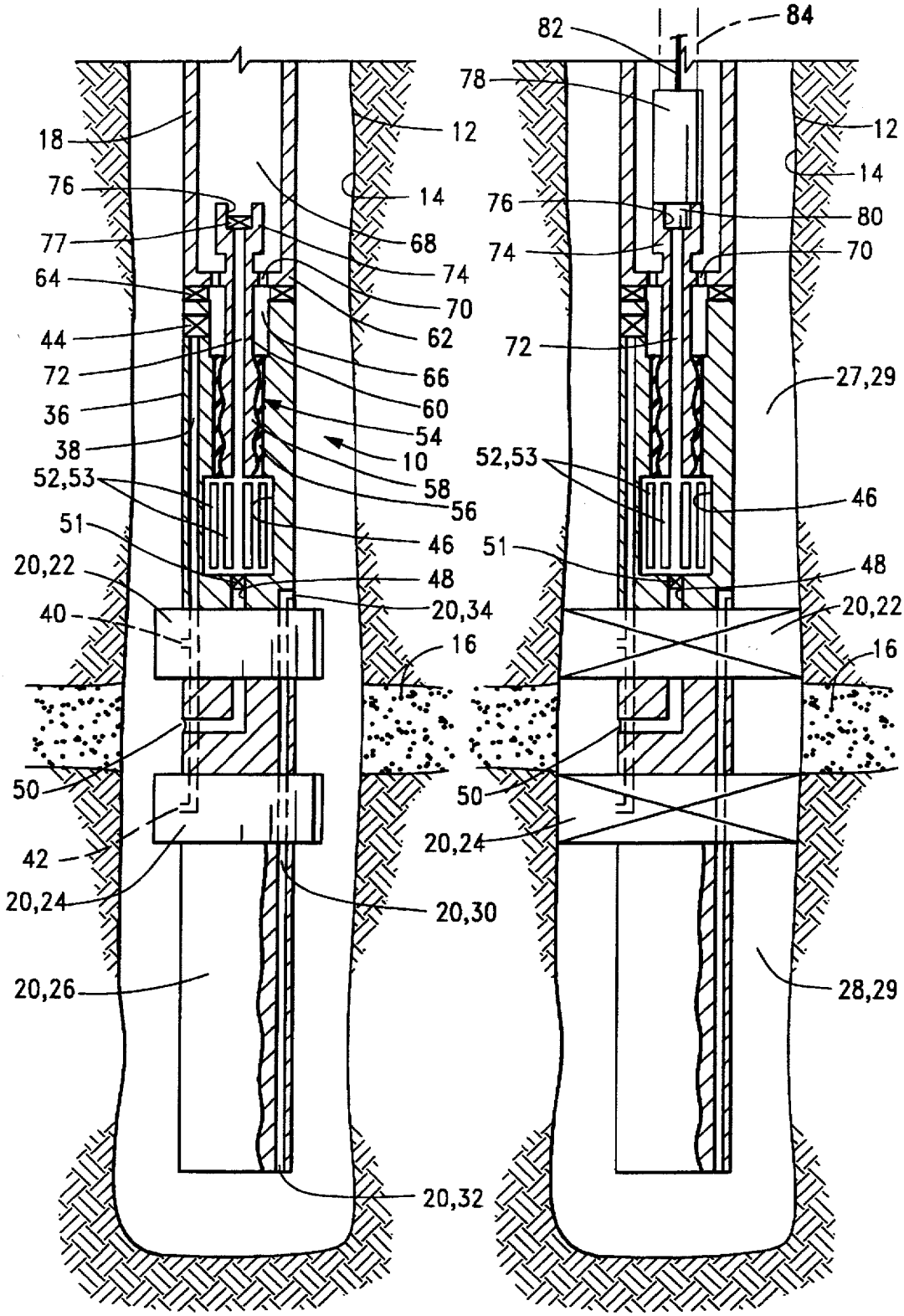
FIGS. 1A and 1B show a first embodiment of the early evaluation system with pump of the present invention in which a formation pump may be actuated by rotation of the tubing string to draw formation fluid into a chamber containing fluid samplers and instrumentation.

The First Embodiment Of FIGS. 1A and 1B

Referring now to the drawings, and more particularly to FIGS. 1A and 1B, a first embodiment of the early evaluation system with pump of the present invention is shown and generally designated by the numeral 10. Apparatus 10 is used in a method of servicing a well 12 having an uncased borehole 14 intersecting a subsurface formation or zone of interest 16. As used herein, a reference to a method of servicing a well is used in a broad sense to include both the testing of the well wherein fluids are allowed to flow from the well and the treatment of a well wherein fluids are pumped into the well. Also as used herein, a reference to a "zone of interest" includes a subsurface formation.

Apparatus 10 is at the lower end of an outer tubing string 18. In a preferred embodiment, apparatus 10 includes a straddle packer assembly 20 having upper and lower inflatable packer elements 22 and 24, respectively. Packer elements 22 and 24 are adapted to sealingly engage borehole 14 on opposite sides of formation 16 or at desired locations in a zone of interest 16. When it is not necessary to seal below formation 16 or in two places in a zone of interest, a single element inflatable packer may be used above the formation or in the zone of interest instead of straddle packer assembly 20. That is, the apparatus is not intended to be limited specifically to a straddle packer configuration. Testing with either type of packer is similar.

A lower housing 26 extends below lower packer element 24. In the illustrated straddle packer embodiment, extending generally longitudinally through straddle packer 20 is an equalizing passage 30 which interconnects a lower equalizing port 32 in lower housing 26 with an upper equalizing port 34 disposed in an upper housing 36. Equalizing passage 30 insures that there is essentially the same hydrostatic pressure in upper portion 27 and lower portion 28 of well annulus 29, above upper packer element 22 and below lower packer element 24, respectively, when the packer elements are inflated. Thus, the system is pressure balanced, and this equalization of pressure across upper and lower packer elements 22 and 24 eliminates hydraulic forces acting on outer tubing string 18 and packer 20.

An inflation passage 38 extends longitudinally through upper housing 36 and is in communication with upper and lower packer elements 22 and 24 at points 40 and 42, respectively. At the upper end of inflation passage 38 is a packer control valve 44 which allows inflation of upper and lower packer elements 22 and 24 by pumping fluid down the inside of outer tubing string 18 and preventing overpressure of the packer elements.

A sampling chamber 46 is defined in upper housing 36. A sampling tube 48 extends from sampling chamber 46 to a plurality of radially disposed sampling ports 50 which are disposed between upper and lower packer elements 22 and 24.

Sampling chamber 46 may be said to be simply an enlarged upper portion of sampling tube 48 in the embodiment of FIGS. 1A and 1B.

Disposed in sampling chamber 46 are a plurality of independently activated samplers 52 and any desired electronic or mechanical pressure and temperature recording instruments 53, also called recorders 53. Samplers 52 may be similar to the Halliburton Mini-samplers, and pressure and temperature recording instruments 53 may be similar to the Halliburton HMR. Examples of Mini-samplers are shown in U.S. Pat. Nos. 5,240,072; 5,058,674; 4,903,765; and 4,787,447, copies of which are incorporated herein by reference. An electronic memory recording fluid resistivity tool, such as manufactured by Sondex or Madden, may also be placed in sampling chamber 46. Samplers 52 and instruments 53 are in communication with sampling tube 48 through sampling chamber 46 in the embodiments shown in FIGS. 1A and 1B.

Figure 4:
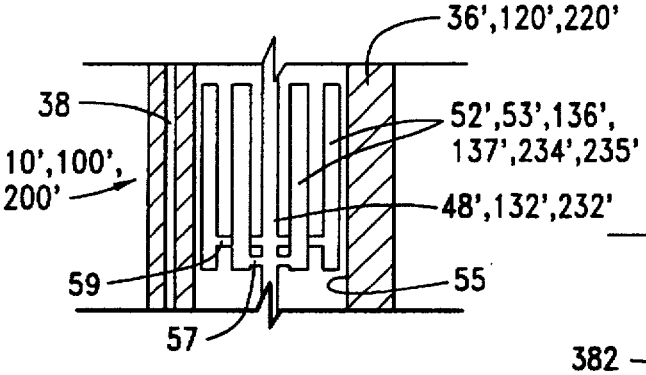
FIG. 4 shows an alternate embodiment of the sampling chamber portion of the apparatus.

An alternate embodiment is shown in FIG. 4. In this alternate embodiment 10', the apparatus has an upper housing 36' defining a cavity 55 therein. A sampling tube 48' extends through cavity 55 but is not actually in fluid communication therewith. A plurality of independently activated samplers 52' and any desired pressure and temperature recording instruments 53', also called recorders 53', are disposed around and adjacent to sampling tube 48'. Samplers 52' and recorders 53' are also not in communication with cavity 55. A plurality of connections, such as 57 and 59 connect sampling tube 48' to samplers 52' and recorders 53'. Those skilled in the art will see that this system operates identically to that shown in FIGS. 1A and 1B even though the components are positioned in a physically different manner. In FIG. 4, samplers 52' and recorders 53' are shown disposed in cavity 55, but the invention is not intended to be limited to this particular configuration. For example, samplers 52' and 53' could be disposed outside of upper housing 36' and connected to sampling tube 48' directly. In such an embodiment, it would not be necessary to have a cavity 55 at all.

In an alternate embodiment, an optional valve 51 may be disposed in sampling tube 48 or 48'. This is shown in FIGS. 1A and 1B but is omitted from FIG. 4. Valve 51 is normally open, but may be closed during a procedure for performing a bubble point calculation, as will be further described herein. In most of the testing using apparatus 10 or 10', however, valve 51 is either fully opened or not present at all.

Disposed above sampling chamber 46 is a formation pump 54 which is used to flow fluid from zone 16 through sampling ports 50 and sampling tube 48 to samplers 52 and recorders 53 in chamber 46 (or to samplers 52' and recorders 53'). In the illustrated embodiment, formation pump 54 is a rotary, progressive cavity pump, commonly referred to as a Moineau or Moyno pump. This type of pump is well known in the art and generally comprises an elastomeric stator 56 with a rotor 58 rotatably disposed therein. The thread-like configuration of rotor 58 in conjunction with stator 56 allows fluid to be pulled upwardly therethrough.

Rotor 58 is connected by a flexible shaft portion 60 to a lower end 62 of outer tubing string 18. As outer tubing string 18 is rotated, shaft portion 60 and rotor 58 are also rotated. Shaft portion 60 must be flexible or some other sort of flexible connection must be used because the center line of rotor 58 moves with respect to the center line of apparatus 10, which is an inherent feature of a progressive cavity pump. That is, rotor 58 wobbles somewhat with respect to stator 56, and thus, a flexible connection is necessary.

As will be further described herein, when packer elements 22 and 24 are inflated, they provide resistance to rotation of upper housing 36 and stator 56. A bearing means 64 also provides a rotatable connection between lower end 62 and upper housing 36.

An annulus 66 is defined around shaft portion 60 in upper housing 36 above stator 56. Communication is provided between annulus 66 and central opening 68 in outer tubing string 18 by a plurality of ports 70. A longitudinal passage 72 extends through shaft portion 60 and rotor 58 and provides communication between sampling tube 48 and central opening 68. In fact, longitudinal passage 72 may be considered a portion of sampling tube 48.

The upper end of longitudinal passage 72 opens into a receptacle 74 which defines a seal bore 76 therein. A normally closed valve 77 is disposed in receptacle 74. In its normally closed position, valve 77 will be seen to close off the upper end of longitudinal passage 72. As will be further described herein, valve 77 is adapted to be opened by an inner well tool.

Operation Of The Embodiment Of FIGS. 1A and 1B

Apparatus 10 is run into well 12 to the desired depth on the end of outer tubing string 18 as seen in FIG. 1A. Fluid is pumped down central opening 68 through ports 70 and into annulus 66. The fluid exits annulus 66 and passes through packer control valve 44 and into inflation passage 38 to inflate packer elements 22 and 24 in a manner known in the art to the position shown in FIG. 1B in which the packer elements are sealingly engaged with borehole 14 on opposite sides of formation 16 or at the desired locations in zone 16.

After packer elements 22 and 24 are inflated, packer control valve 44 closes to prevent over-inflation of the packer elements, and outer tubing string 18 is rotated at the surface. As previously described, this rotates rotor 58 of pump 54 within stator 56. Rotation of packer assembly 20 and upper housing 36 is prevented by the inflated engagement of packer elements 22 and 24 with borehole 14.

As outer tubing string 18 is rotated, pump 54 draws fluid from formation or zone 16 through sampling ports 50 and sampling tube 48. This fluid is discharged from pump 54 through annulus 66 and longitudinal passage 70 into central opening 68. Pump 54 is actuated in this manner for a predetermined period of time in order to draw down zone 16. The flow from zone 16 should displace fluid standing in central opening 68 of outer housing 18, and a good estimate of the production rate from the zone should be available by monitoring the flow rate at the surface. It is possible to control the production rate by varying the rotation of outer tubing string 18 at the surface. The rate of flow through pump 54 varies directly with the rotational speed thereof.

During this time, real time measurements of pressure, temperature and fluid resistivity of the contents of sampling tube 48 may be sent to the surface via a telemetry system (not shown). These quantities can be observed to determine if the fluid in sampling tube 48 is free of contamination by a mud filtrate. By observing the temperature of the sampling fluid, evidence of flashing the formation fluid is seen as a sudden decrease of temperature.

After a predetermined time period, one of samplers 52 may be activated and a sample of the fluid in sampling tube 48 taken by flowing into the sampler 52. Operation of any sampler 52 is optional.

It may also be desired to measure formation or zone pressure during one or more draw-down/build-up sequences at a particular depth while capturing only one sample of formation fluid. Alternatively, the measurement of zone pressures by recorders 53 may be carried out without capturing any sample if desired.

Rotation is halted, which ends the operation of pump 54, and the flow of fluid from zone 16 is accordingly stopped. At this point, zone 16 is "shut in." This build-up phase may be maintained for another predetermined period of time. Samples may be taken in additional samplers 52 and measurements recorded in additional recorders 53 during one of these draw-down/build-up sequences as previously mentioned.

In FIG. 1B, a secondary or inner well tool 78 has been lowered into engagement with outer tubing string 18 until a stinger element 80 thereof is closely received within seal bore 76 of receptacle 74. This places inner well tool 78 in fluid communication with zone 16 through sampling tube 48 and longitudinal passage 72 by opening the closed valve 77 in receptacle 74. Inner well tool 78 may be dropped by gravity, pumped down, or conveyed on slick or electric wireline 82 or coiled tubing 84 (shown in phantom lines in FIG. 1B) or on smaller joints of tubing or pipe.

Potential inner well tools 78 which may be carried by gravity or pumped down include: wireline, coiled tubing or drill pipe retrievable samplers; wireline, coiled tubing or drill pipe retrievable electronic or mechanical pressure/temperature recorders; fluid chambers which may contain chemicals to be injected into zone 16; and a sub which simply opens valve 77 in receptacle 74 so that zone 16 may be in communication with the tubing. Potential inner well tools 78 which may be carried by a coiled tubing or slickline include those tools just mentioned. Potential secondary tools which may be carried by electric line include those listed above plus instruments for real time surface read-out pressure/temperature and/or fluid properties.

Inner well tool 78 opens valve 77 in receptacle 74 and thus makes an isolated hydraulic connection between inner well tool 78 and zone 16.

In one preferred embodiment, inner well tool 78 is a surge chamber which may be used to collect a fluid sample from zone 16 which can then be collected by retrieving the surge chamber with wireline 82 or coiled tubing 84. As mentioned, inner well tool 78 may also be a pressurized fluid injection canister which is adapted for injecting a treatment fluid into zone 16 through longitudinal passageway 72 and sampling tube 48.

When inner well tool 78 is on coiled tubing 84, fluid from zone 16 can be flowed upwardly through the coiled tubing string to a surface location. Also, treatment fluids can be pumped down through coiled tubing 84 or a similar joint of tubing or pipe into zone 16.

After the samples and recordings have been taken, tension is applied to outer tubing string 18 which releases pressure from inflatable packer elements 22 and 24. Apparatus 10, with the exception of any sampler 52 or 52' which was activated as previously described, is then ready for repositioning in well 12 adjacent another formation or zone. At this point, the operational sequence can be repeated as desired.

After completion of the last test, apparatus 10 is retrieved to the surface. There, samplers 52, 52' and recorders 53, 53' are removed from sampling chamber 46. Samplers 52, 52' may be drained on location, their contents may be transferred to sample bottles for shipment to a pressure-volume-test (PVT) laboratory, or the entire sampler 52, 52' may be shipped to a PVT laboratory for fluid transfer and testing.

Memory gauges and recorders 53, 53' can be read, and the pressure, temperature and resistivity data analyzed to determine formation or zone pressure and temperature, permeability, and sample fluid resistivity. A change in sample fluid resistivity during each draw-down phase of the job indicates that the mud filtrate was removed from zone 16 and that fluid pumped through apparatus 10 near the end of the draw-down that was captured in sampler 52, 52' is a representative fluid in the zone. A significant change in fluid temperature during the draw-downs would indicate that gas dissolved in the formation fluid came out of solution and flashed to vapor during the draw-down and/or during sampling.

In the embodiment of apparatus 10 or 10' which includes the previously mentioned valve 51, a determination of the bubble point of the well fluid may be carried out. With the apparatus positioned in wellbore 14 as shown in FIG. 1B, pump 54 is actuated by rotating outer tubing string 18, in the manner previously described, and the pump is run long enough to get formation fluid inside sampling tube 48 and sampling chamber 46 (or in sampling tube 48' in embodiment 10'). With formation fluid thus inside the tool, valve 51 is closed to trap a volume of fluid between the valve and pump 54. Pump 54 is then operated to reduce the pressure of the trapped fluid sample. As the pressure is decreased inside the trapped volume of fluid, eventually the pressure will drop below the bubble point of the oil contained in the trapped volume of fluid. When the pressure drops below the bubble point, a phase change will occur in the sample as gas breaks out of solution. Pressure and temperature recording instruments 53 or 53' are used to detect the pressure at which the phase change occurs. Before the pressure falls below the bubble point, the pressure inside the sample will reduce sharply as the pump is run. When the pressure drops below the bubble point, the gas expansion in the sample will cause the pressure to drop much less sharply. This indicates the bubble point.

Figures 2A, 2B:
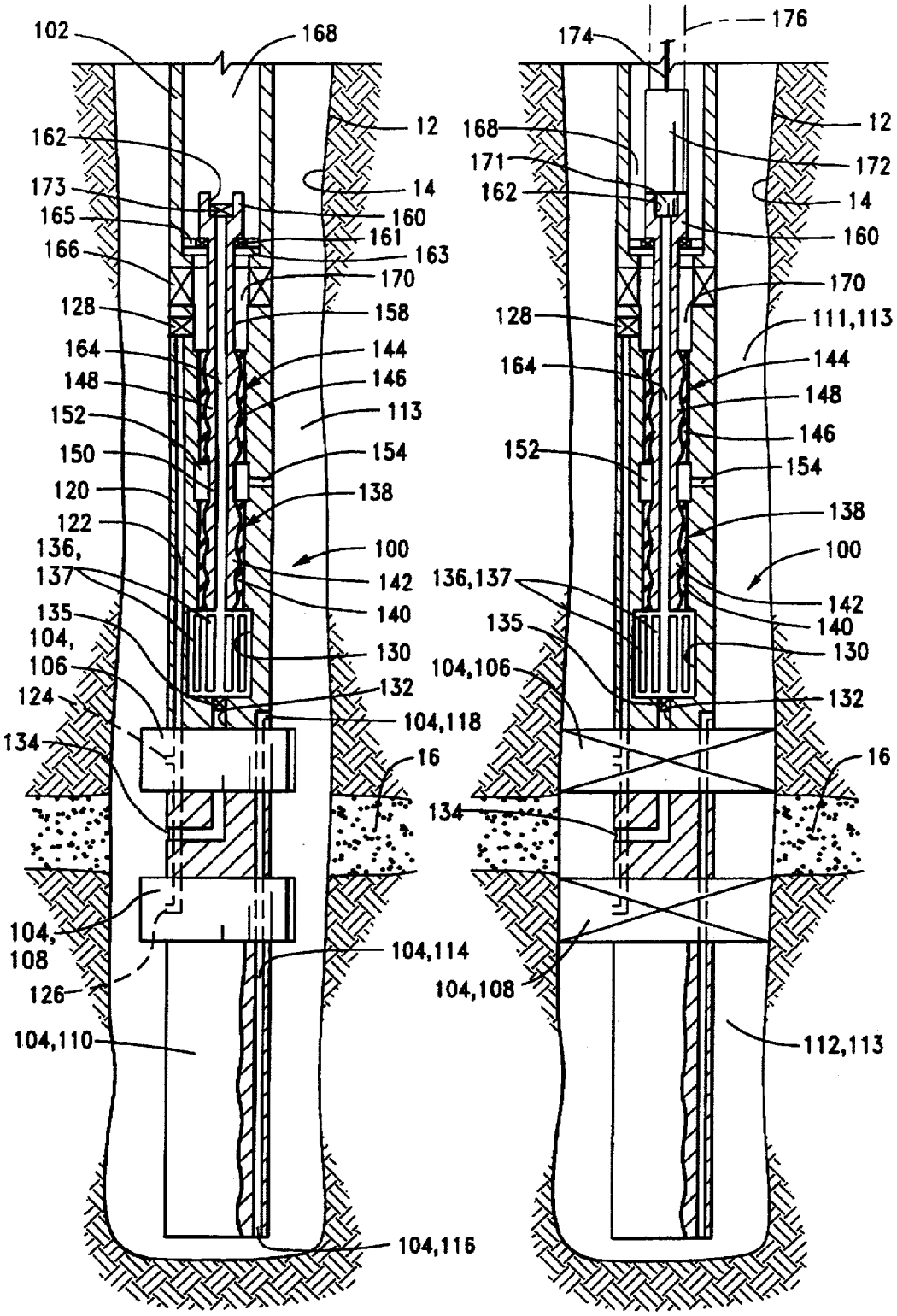
FIGS. 2A and 2B show another embodiment of the present invention in which a hydraulic or mud motor is used to actuate the formation pump by pumping mud down the tubing string.

The Second Embodiment Of FIGS. 2A And 2B

Referring now to FIGS. 2A and 2B, a second embodiment of the early evaluation system with pump of the present invention is shown and generally designated by the numeral 100. Like the first embodiment apparatus 10, second embodiment 100 may be used in a method of servicing a well 12 having an uncased borehole 14 intersecting a subsurface formation or zone 16. As will be described in more detail herein, second embodiment apparatus 100 actuates a pump therein by hydraulic actuation means such as a hydraulic or mud motor 144 rather than by rotation of the tubing string as in first embodiment apparatus 10. Those skilled in the art will appreciate that many of the components of apparatus 100 are similar or identical to those in the first embodiment.

Apparatus 100 is at the lower end of an outer tubing string 102. In a preferred embodiment, apparatus 100 includes a straddle packer assembly 104 having upper and lower inflatable packer elements 106 and 108, respectively. Packer elements 106 and 108 are adapted to sealingly engage borehole 14 on opposite sides of formation 16 or at desired locations in a zone of interest 16. As with first embodiment apparatus 10, when it is not necessary to seal below formation 16 or in two places in a zone of interest with second embodiment apparatus 100, a single inflatable packer may be used above the formation or zone instead of straddle packer assembly 104. That is, apparatus 100 is not intended to be limited specifically to a straddle packer configuration. Testing with either type of packer is similar.

A lower housing 110 extends below lower packer element 108. In the illustrated straddle packer embodiment, extending generally longitudinally through straddle packer 104 is an equalizing passage 114 which interconnects a lower equalizing port 116 in lower housing 110 with an upper equalizing port 118 in an upper housing 120. Equalizing passage 114 insures that there is essentially the same hydrostatic pressure in upper portion 111 and lower portion 112 of well annulus 113 above upper packer element 106 and below lower packer element 108, respectively, when the packer elements are inflated. Thus, the system is pressure-balanced, and this equalization of pressure across upper and lower packer elements 106 and 108 eliminates hydraulic forces acting on outer tubing string 102 and packer 104.

An inflation passage 122 extends longitudinally through upper housing 120 and is in communication with upper and lower packer elements 106 and 108 at points 124 and 126, respectively. At the upper end of inflation passage 122 is a packer control valve 128 which allows inflation of upper and lower packer elements 106 and 108 by pumping fluid down the inside of outer tubing string 102 and preventing overpressure of the packer elements.

A sampling chamber 130 is defined in upper housing 120. A sampling tube 132 extends from sampling chamber 130 to a plurality of radially disposed sampling ports 134 which are disposed between upper and lower packer elements 106 and 108. Sampling chamber 130 may be said to be simply an enlarged upper portion of sampling tube 132 in the embodiment of FIGS. 2A and 2B.

Disposed in sampling chamber 130 are a plurality of independently activated samplers 136 and any desired electronic or mechanical pressure and temperature recording instruments 137, also referred to as recorders 137. As in the first embodiment, samplers 136 in the second embodiment may be similar to Halliburton Mini-Samplers, and the pressure and electronic pressure and temperature recording instruments 137 may be similar to the Halliburton HMR. An electronic memory recording fluid resistivity tool, such as manufactured by Sondex or Madden, may also be placed in sampling chamber 130. Samplers 136 and instruments 137 are in communication with sampling tube 132 through sampling chamber 130 in the embodiments shown in FIGS. 2A and 2B.

An alternate embodiment is shown in FIG. 4. In this alternate embodiment 100', the apparatus has an upper housing 120' defining a cavity 55 therein. A sampling tube 132' extends through cavity 55 but is not actually in fluid communication therewith. A plurality of independently activated samplers 136' and any desired pressure and temperature recording instruments 137', also called recorders 137', are disposed around and adjacent to sampling tube 132'. Samplers 136' and recorders 137' are also not in communication with cavity 55. A plurality of connections, such as 57 and 59 connect sampling tube 132' to samplers 136' and recorders 137'. Those skilled in the art will see that this system operates identically to that shown in FIGS. 2A and 2B even though they are positioned in a physically different manner. In FIG. 4, samplers 136' and recorders 137' are shown disposed in cavity 55, but the invention is not intended to be limited to this particular configuration. For example, samplers 136' and 137' could be disposed outside of upper housing 120' and connected to sampling tube 132' directly. In such an embodiment, it would not be necessary to have a cavity 55 at all.

In an alternate embodiment, an optional valve 135 may be positioned in sampling tube 132 or 132'. This is shown in FIGS. 2A and 2B but omitted from FIG. 4. Valve 135 is normally open, but may be used to perform a bubble point calculation as with valve 51 in the first embodiment.

Disposed above sampling chamber 130 is a formation pump 138 which is used to flow fluid from zone 16 through sampling ports 134 and sampling tube 132 to samplers 136 and recorders 137 in chamber 130 (or to samplers 136' and recorders 137'). In the illustrated embodiment, formation pump 138 is a rotary, progressive cavity pump, commonly referred to as a Moineau or Moyno pump, just as in first embodiment 10. Pump 138 generally comprises an elastomeric pump stator 140 with a pump rotor 142 rotatably disposed therein. The thread-like configuration of pump rotor 142 in conjunction with pump stator 140 allows fluid to be pulled upwardly therethrough.

Located above pump 138 is a hydraulic motor 144 which may also be referred to as a mud motor 144. In the illustrated embodiment, motor 144 is a rotary, progressive cavity device (Moineau or Moyno) similar to formation pump 138. Motor 144 is of a configuration known in the art and generally comprises an elastomeric motor stator 146 with a motor rotor 148 rotatably disposed therein. Motor rotor 148 is connected to pump rotor 142 by a flexible shaft portion 150. As illustrated in FIG. 2, pump rotor 142, shaft portion 150 and motor rotor 148 are shown as a single piece, but multiple-piece construction may be used so long as the components rotate together. The thread-like configuration of motor rotor 148 in conjunction with motor stator 146 causes the motor rotor to rotate as fluid is pumped downwardly through outer tubing string 102, as will be further discussed herein.

Upper housing 120 defines an annular cavity 152 therein through which shaft portion 150 extends. A housing port 154 is defined transversely through upper housing 120 and provides communication between annular cavity 152 and well annulus 113.

Motor rotor 148 is connected by a flexible shaft portion 158 to a receptacle 160. Shaft portions 150 and 158 must be flexible or some other sort of flexible connection must be used because the center lines of pump rotor 142 and motor rotor 148 move with respect to the center line of apparatus 100, which is an inherent feature of a progressive cavity pump or motor. That is, pump rotor 142 wobbles somewhat with respect to pump stator 140, and motor rotor 148 wobbles somewhat with respect to motor stator 146. Thus, a flexible connection is necessary.

Pump 138 and hydraulic motor 144 are supported against longitudinal movement as a result of pressure acting thereon by a thrust bearing 161 which is mounted on a flange 163 and engaged by receptacle 160. Flange 161 defines an opening 165 therethrough so that fluid may flow past the flange.

Receptacle 160 defines a seal bore 162 therein. A normally closed valve 173 is disposed in receptacle 160. As will be further described herein, valve 173 is adapted to be opened by an inner well tool.

The entire assembly comprising receptacle 160, shaft portion 158, motor rotor 148, shaft portion 150 and pump rotor 142 define a longitudinal passage 164 therethrough. Thus, longitudinal passage 164 provides communication between seal bore 162 and sampling chamber 130. In its normally closed position, valve 173 will be seen to close off the upper end of longitudinal passage 164. Longitudinal passage 164 may be considered a portion of sampling tube 132.

A telemetry system 166 including a mud pulser unit is disposed above hydraulic motor 144. This telemetry system 166 is of a kind known in the art, such as the Halliburton Measurement While Drilling (MWD) or Logging While Drilling (LWD) telemetry systems. The purpose of system 166 is to send measured data from apparatus 100 to the surface in real time while circulating fluid or while running pump 138 which draws down the well. The telemetry system 166 makes it possible to make gamma and resistivity measurements in real time as apparatus 100 is run into well 12. This allows correlation of packer depth without the need of an electric wireline.

Telemetry 166 is required in second embodiment 100 because the fluid is discharged from pump 138 into well annul us 113 a s further described herein. That is, the fluid discharged from pump 138 is not pumped into outer tubing string 102 where the volume thereof is known as it is when pumped into outer tubing string 18 of first embodiment 10. Telemetry 166 may be used with first embodiment 10 if desired, but it is not necessary.

Outer tubing string 102 defines a central opening 168 therethrough which is in communication with hydraulic motor 144 through opening 165 in flange 163 and an annular volume 170 generally defined around shaft portion 158. Packer control valve 128 is also in communication with annular volume 170.

Operation of The Embodiment Of FIGS. 2A And 2B

Apparatus 100 is run into well 12 to the desired depth on the end of outer tubing string 102 as seen in FIG. 2A. As packer assembly 104 nears the desired setting depth, circulation is started so that telemetry system 166 can send correlation data to the surface with the mud pulser.

When apparatus 100 is on depth, additional pressure is applied down the tubing to inflate packer elements 106 and 108. Fluid is pumped down central opening 168 through opening 165 and annular volume 170, then passes through packer control valve 128 into inflation passage 122. Packer elements 106 and 108 are inflated to the position shown in FIG. 2B in which the packer elements are sealingly engaged with borehole 14 on opposite sides of formation 16 or at the desired locations in zone 16.

After packer elements 106 and 108 are inflated, packer control valve 128 closes to prevent over-inflation of the packer elements.

Thereafter, any additional fluid circulated down opening 165 and central opening 168 will be forced through hydraulic motor 144, thus causing motor rotor 148 to rotate within motor stator 146. This results in pump rotor 142 being rotated within pump stator 140 as previously described. Fluid discharged from the lower end of motor 144 is exhausted into well annulus 113, as previously mentioned, after passing through annular cavity 152 and housing port 154 and subsequently circulated out of well 12.

As hydraulic motor 144 is thus actuated, pump 138 draws fluid from formation or zone 16 through sampling ports 134 and sampling tube 132. This fluid is discharged from pump 138 through annular cavity 152 and housing port 154 into well annulus 113. Pump 138 is actuated for a period of time in order to draw down zone 16. It is possible to control the formation or zone fluid production rate by controlling the circulation rate through central opening 168 from the surface. The pumping flow rate varies directly with the circulation rate since the circulated fluid is what drives hydraulic motor 144.

During this time, measurements of the physical properties of the fluid produced from zone 16 such as pressure, temperature, density, resistivity, conductivity, dielectric constant or other measurable physical fluid property can be used to determine if the fluid produced from zone 16 contains gas.

If gas is present in the fluid produced from zone 16, pumping performed on the zone of interest and the resulting commingling of fluid from the zone with the mud in annulus portion 111 above packer 104 should be limited. This is necessary because, as the commingled gas and mud circulate toward the surface, the gas in this mixture will expand. If a large quantity of gas is present in the fluid from zone 16, this may result in a significant decrease in the hydrostatic pressure of the column of fluid in annulus 113 and may result in a well control problem.

Measurements of the physical properties of the fluid produced from zone 16 can be sent to the surface in real time by telemetry system 166. With knowledge of these parameters, an operator at the surface may determine that gas is present and may stop or limit operation of pump 138. Alternatively, apparatus 100 may also contain sufficient downhole computer processing power to observe the physical properties the fluid from zone 16, make the determination that gas is present, and transmit an alarm to the surface via telemetry system 166.

After a predetermined flow time or after determining that the draw-down of zone 16 is sufficient by observation of the real time data sent to the surface, one of samplers 136 may be activated in order to take a sample of the fluid in sampling tube 132. The operation of this sampler 136 may be initiated by modulating the mud pumps at the surface as a down link command. Operation of any sampler 136 is optional.

It may be desired to measure formation or zone pressure using recorders 137 or 137 during one or more draw-downs/build-up sequences at one depth while capturing only one or more sample of formation fluid. Alternatively, the measurement of zone pressures with recorders 137 without capturing a sample may be desired.

After the measurements are taken, fluid circulation is halted, and the flow from zone 16 is stopped. This build-up phase is maintained for a period of time. Samples may be taken in additional samplers 136, 136' and measurements recorded in additional recorders 137, 137' during one of these draw-down/build-up sequences as previously mentioned.

Alternately, mud pumps at the surface can be used to send a command to apparatus 100 to stop formation pump 138 and start the build-up while maintaining circulation. During this phase of the test, real time build-up pressure is sent to the surface via telemetry. By observing the build-up pressure at the surface, an informed decision about when to end the build-up or test can be made.

Receptacle 160 provides a means of connecting a secondary or inner well tool 172 which may be lowered down to apparatus 100 through outer tubing string 102 until a stinger element 171 thereof is closely received within seal bore 162 of receptacle 160. This. places inner well tool 172 in fluid communication with zone 16 through sampling tube 132 and longitudinal passage 164 by opening the closed valve 173 in receptacle 160. Inner well tool 172, like inner well tool 78 of the first embodiment, may be dropped by gravity, pumped down, or conveyed on a slickline or wireline 174 or a coiled tubing string 176 or smaller joints of tubing or pipe, as seen in FIG. 2B.

Inner well tool 172 can be used to open valve 173 in receptacle 160 to make an isolated hydraulic connection between inner well tool 172 and formation 16. Potential inner well tools 172 which may be carried by gravity or pumped down include: wireline, coiled tubing or drill pipe retrievable samplers; wireline, coiled tubing or drill pipe retrievable electronic or mechanical pressure/temperature recorders; fluid chambers which may contain chemicals to be injected into zone 16; and a sub which simply opens valve 173 in receptacle 172 so that zone 16 may be in fluid communication with outer tubing string 102.

Potential inner well tools 172 which may be carried by coiled tubing or slick line include any of those listed above. Potential inner well tools 172 which may be carried by electric line include those listed above plus instruments for real time surface readout pressure/temperature and/or fluid properties.

Preferred embodiments of inner well tool 172 are the same as those described for inner well tool 78 of first embodiment apparatus 10.

When the test is complete, tension is applied to outer tubing string 102 to release pressure from packer elements 106 and 108. This also releases pressure from all of apparatus 100 with the exception of any sampler 136 or 136' which has been activated. Apparatus 100 may then be repositioned in well 12, and the operational sequence can be repeated several times if desired.

After completion of the final test, apparatus 100 is retrieved to the surface. There, samplers 136, 136' and recording instruments 137, 137' are removed from sampling chamber 130. Samplers 136, 136' may be drained on location, their contents may be transferred to sample bottles for shipment to a PVT laboratory, or the entire sampler 136, 136' may be shipped to a PVT laboratory for fluid transfer and testing.

During most of the tests, real time data is sent to the surface via the pulser. However, data rates attainable with this technology are relatively slow, e.g., on the order of one to two bits per second. A much more detailed picture of what happened downhole during the test is available from analyzing data stored in apparatus 100 during the job.

The memory gauges in instruments 137, 137' can be read, and the pressure, temperature and resistivity data can be analyzed to determine formation pressure and temperature, permeability, and sample fluid resistivity. A change in sample fluid resistivity during each draw-down phase of the job would indicate that the mud filtrate was removed from zone 16 and that the fluid pumped through apparatus 100 near the end of the draw-down that was captured in the activated sampler 136, 136' is a representative fluid in the zone. A significant change in fluid temperature during the draw-downs would indicate that gas dissolved in the formation fluid came out of solution and flashed to vapor during the draw-down and/or during sampling.

In the embodiment of apparatus 100 or 100' which includes the previously mentioned valve 135, a calculation of the bubble point of the well fluid may be carried out. With the apparatus positioned in wellbore 14 as shown in FIG. 2B, pump 138 is actuated in the manner previously described, and the pump is run long enough to get formation fluid inside sampling tube 132 and sampling chamber 130 (or in sampling tube 132' in embodiment 100'). With formation fluid thus inside the tool, valve 135 is closed to trap a volume of fluid between the valve and pump 138. Pump 138 is then operated to reduce the pressure of the trapped fluid sample. As the pressure is decreased inside the trapped volume of fluid, eventually the pressure will drop below the bubble point of the oil contained in the trapped volume of fluid. When the pressure drops below the bubble point, a phase change will occur in the sample as gas breaks out of solution. Pressure and temperature recording instruments 137 or 137' are used to detect the pressure at which the phase change occurs. Before the pressure falls below the bubble point, the pressure inside the sample will reduce sharply as the pump is run. When the pressure drops below the bubble point, the gas expansion in the sample will cause the pressure to drop much less sharply. This indicates the bubble point.

Figures 3A, 3B:
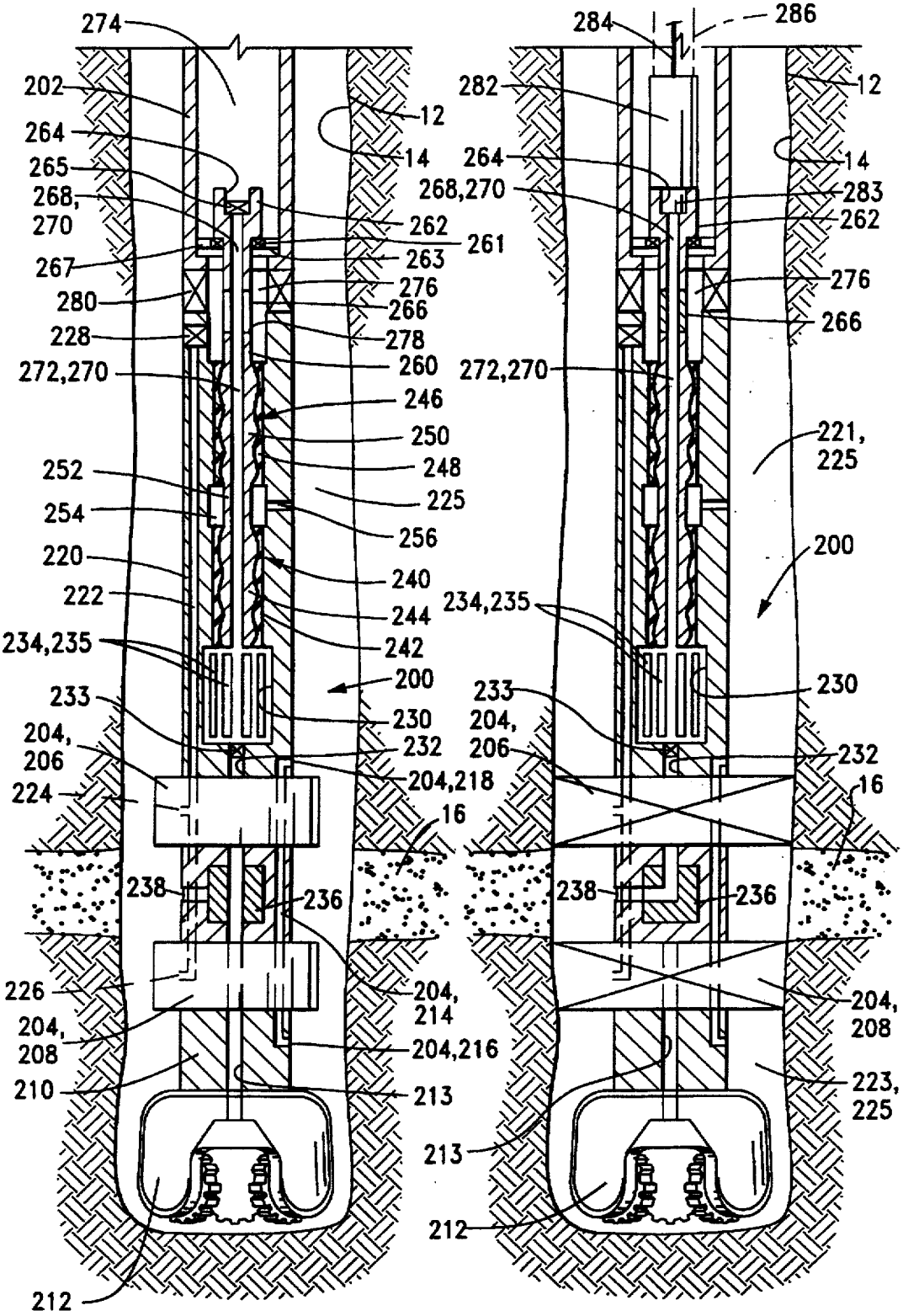
FIGS. 3A and 3B illustrate an embodiment of the invention utilized as part of a drill string by which drilling may be carried out and testing conducted without removal of the drill string.

The Third Embodiment Of FIGS. 3A and 3B

A third embodiment of the early evaluation system with pump of the present invention is shown in FIGS. 3A and 3B and generally designated by the numeral 200. Apparatus 200, like the first and second embodiments, is used in a method of drilling and servicing a well 12 having an uncased borehole 14 intersecting a subsurface formation or zone 16. However, apparatus 200 is also incorporated into a drill string so that such servicing can be carried out without removing the drill string from well 12.

Apparatus 200 is at the lower end of an outer drilling string 202 which may also be referred to as a tubing string 202. In a preferred embodiment, apparatus 200 includes a straddle packer assembly 204 having upper and lower inflatable packer elements 206 and 208, respectively. Packer elements 206 and 208 are adapted to sealingly engage borehole 14 on opposite sides of formation 16 or at desired locations in a zone of interest 16. When it is not necessary to seal below formation 16 or in two places in a zone of interest, a single element inflatable packer may be used above the formation or zone instead of straddle packer assembly 204. That is, as with the other embodiments, apparatus 200 is not intended to be limited specifically to a straddle packer configuration. Testing with either packer is similar.

A lower housing 210 extends below lower packer element 208. Below lower housing 210 is a drill bit 212, of a kind known in the art, which is used to drill borehole 14 by rotation of outer tubing string 202. A tube or passageway 213 extends through lower housing 210 and opens at its lower end adjacent to drill bit 212. As will be further described, tube 213 allows drilling fluid to be pumped to drill bit 212 during a drilling operation.

In the illustrated straddle packer embodiment, extending generally longitudinally through straddle packer 204 is an equalizing passage 214 which interconnects a lower equalizing port 216 in lower housing 210 with an upper equalizing port 218 in an upper housing 220. Equalizing passage 214 insures that there is essentially the same hydrostatic pressure in upper portion 221 and lower portion 223 of well annulus 225, above upper packer element 206 and below lower packer element 208, respectively, when the packer elements are inflated. Thus, the system is pressure-balanced, and this equalization of pressure across upper and lower packer elements 206 and 208 eliminates hydraulic forces acting on outer tubing string 202 and packer 204.

An inflation passage 222 extends longitudinally through upper housing 220 and is in communication with upper and lower packer elements 206 and 208 at points 224 and 226, respectively. At the upper end of inflation passage 222 is a packer control valve 228 which allows inflation of upper and lower packer elements 206 and 208 by pumping fluid down outer tubing string 202 and preventing overpressure of the packer elements.

A sampling chamber 230 is defined in upper housing 220. A sampling tube 232 extends longitudinally from sampling chamber 230. Sampling chamber 230 may be said to be simply an enlarged upper portion of sampling tube 232 in the embodiment of FIGS. 3A and 3B.

Disposed in sampling chamber 230 are a plurality of independently activated samplers 234 and any desired electronic or mechanical pressure and temperature recording instruments 235, also called recorders 235. As in the other embodiments, samplers 234 in the third embodiment may be similar to Halliburton Mini-Samplers, and pressure and temperature recording instruments 235 may be similar to the Halliburton HMR. An electronic memory recording resistivity tool, such as manufactured by Sondex or Madden, may also be placed in sampling chamber 230. Samplers 234 and instruments 235 are in communication with sampling tube 232 through sampling chamber 230 in the embodiments shown in FIGS. 3A and 3B.

An alternate embodiment is shown in FIG. 4. In this alternate embodiment 200', the apparatus has an upper housing 220' defining a cavity 55 therein. A sampling tube 232' extends through cavity 55 but is not actually in fluid communication therewith. A plurality of independently activated samplers 234' and any desired pressure and temperature recording instruments 235', also called recorders 235', are disposed around and adjacent to sampling tube 232'. Samplers 234' and recorders 235' are also not in communication with cavity 55. A plurality of connections, such as 57 and 59 connect sampling tube 232' to samplers 234' and recorders 235'. Those skilled in the art will see that this system operates identically to that shown in FIGS. 3A and 3B even though they are positioned in a physically different manner. In FIG. 4, samplers 234' and recorders 235' are shown disposed in cavity 55, but the invention is not intended to be limited to this particular configuration. For example, samplers 234' and 235' could be disposed outside of upper housing 220' and connected to sampling tube 232' directly. In such an embodiment, it would not be necessary to have a cavity 55 at all.

In an alternate embodiment, an optional valve 233 may be positioned in sampling tube 232 or 232'. This is shown in FIGS. 3A and 3B but omitted from FIG. 4. Valve 233 is normally open, but may be closed to perform a bubble point calculation as previously described for the first embodiment.

A lower circulating valve 236 is disposed in packer 204 between packer elements 206 and 208. Lower circulating valve 236 may be actuated between a first, drilling position shown in FIG. 3A and a second, formation evaluation or test position shown in FIG. 3B. In the drilling position, lower circulating valve 236 places sampling tube 232 in communication with tube 213 so that drilling fluid may be pumped through packer 204 to drill bit 212, as will be further described herein. In the evaluation position, lower circulating valve 236 closes communication between sampling tube 232 and tube 213 and places the sampling tube in communication with a plurality of radially disposed sampling ports 238 between packer elements 206 and 208. Thus, when lower circulating valve 236 is in the evaluation position, sampling ports 238 are in communication with sampling chamber 230.

Disposed above sampling chamber 230 is a formation pump 240 which is used to flow fluid from zone 16 through sampling ports 238 and sampling tube 232 to samplers 234 and recorders 235 in chamber 230 when lower circulating valve 236 is in the evaluation position (or to samplers 234' and recorders 235'). In the illustrated embodiment, formation pump 240 is a rotary, progressive cavity pump, commonly referred to as a Moineau or Moyno pump just as in first embodiment 10 and second embodiment 100. Pump 240 generally comprises an elastomeric pump stator 242 with a pump rotor 244 rotatably disposed therein. The thread-like configuration of pump rotor 244 in conjunction with pump stator 242 allows fluid to be pulled upwardly therethrough.

In a manner similar to second embodiment 100, located above pump 240 is a hydraulic motor 246 which may also be referred to as a mud motor 246. In the illustrated embodiment, motor 246 is a rotary, progressive cavity device (Moineau or Moyno) similar to formation pump 240. Motor 246 is of a configuration known in the art and generally comprises an elastomeric motor stator 248 with a motor rotor 250 rotatably disposed therein. Motor rotor 250 is connected to pump rotor 244 by a flexible shaft portion 252. As illustrated in FIG. 3, pump rotor 244, shaft portion 252 and motor rotor 250 are shown as a single piece, but multiple-piece construction may be used so long as the components rotate together. The thread-like configuration of motor rotor 250 in conjunction with motor stator 248 causes the motor rotor to rotate as fluid is pumped downwardly through outer tubing string 202, as will be further discussed herein.

Upper housing 220 defines an annular cavity 254 therein through which shaft portion 252 extends. A housing port 256 is defined transversely through upper housing 220 and provides communication between annular cavity 254 and well annulus 225.

Motor rotor 250 is connected by a flexible shaft portion 260 to a receptacle 262. Shaft portions 252 and 260 must be flexible or some other sort of flexible connection must be used because the center lines of pump rotor 244 and motor rotor 250 move with respect to the center line of apparatus 200, which is an inherent feature of a progressive cavity pump or motor. That is, pump rotor 244 wobbles somewhat with respect to pump stator 242, and motor rotor 250 wobbles somewhat with respect to motor stator 248. Thus, a flexible connection is necessary.

Pump 240 and hydraulic motor 246 are supported against longitudinal movement as a result of pressure acting thereon by a thrust bearing 261 which is mounted on a flange 263 and engaged by receptacle 263. Flange 265 defines an opening 267 therethrough which allows fluid flow past the flange.

Receptacle 262 defines a seal bore 264 therein. A normally closed valve 265 is disposed in receptacle 262.

An upper circulating valve 266 is positioned in or adjacent to shaft portion 260. Receptacle 262 and an upper end of shaft portion 260 define an upper portion 268 of a longitudinal passage 270 above upper circulating valve 266. In its normally closed position, valve 265 will be seen to close off the upper end of longitudinal passage 270. A lower end of shaft portion 260, motor rotor 250, shaft portion 252 and pump rotor 244 define a lower portion 272 of longitudinal passage 270 below lower circulating valve 266.

Telemetry 280 is required in third embodiment 200 because the fluid is discharged from pump 240 into well annulus 225. That is, the fluid discharged from pump 240 is not pumped into outer tubing string 202 where the volume thereof is known as it is when pumped into outer tubing string 18 of first embodiment 10.

Outer tubing string 202 defines a central opening 274 therethrough which is in communication with upper circulating valve 266 and with hydraulic motor 246 through opening 267 in flange 265 and an annular volume 276 generally defined around shaft portion 260. Packer control valve 228 is also in communication with annular volume 276.

Upper circulating valve 266 has a first, drilling position shown in FIG. 3A and a second, formation evaluation or test position shown in FIG. 3B. In the drilling position, a port 278 in upper circulating valve 266 is open so that annular volume 276 is in communication with longitudinal passage 270. In the evaluation position, upper circulating valve 266 is closed so that longitudinal passage 270 is isolated from annular volume 276 while upper portion 268 and lower portion 272 of longitudinal passage 270 are in communication with one another.

The drilling position of upper circulating valve 266 corresponds to the drilling position of lower circulating valve 236, and similarly, the formation evaluation position of upper circulating valve 266 corresponds to the formation evaluation position of lower circulating valve 236. When the two valves are in their drilling positions, it will be seen that central opening 274 of outer tubing string 202 is in communication with drill bit 212 so that drilling fluid or mud may be pumped downwardly through apparatus 200 during drilling operations. When the circulating valves are in their evaluation positions, communication is provided between seal bore 264 and sampling chamber 230, and the sampling chamber is further in communication with sampling ports 238.

A telemetry system 280 including a mud pulser unit is disposed above hydraulic motor 246. The telemetry system 280 is of a kind known in the art, such as the Halliburton MWD or LWD telemetry systems, such as previously described with regard to second embodiment 100. The purpose of system 280 is to send measured data from apparatus 200 to the surface in real time while circulating fluid, while running pump 240 which draws down the well, or while drilling. The telemetry system 280 makes it possible to make gamma and resistivity measurements in real time as apparatus 200 is used to drill well 12. This allows correlation of packer depth without the need of an electric wireline.

Operation Of The Embodiment Of FIGS. 3A And 3B

Apparatus 200 is initially configured as shown in FIG. 3A with upper and lower circulating valves 266 and 236 in their first or drilling positions. Normally, well 12 has already been started, and apparatus 200 is positioned so that drill bit 212 is adjacent to the bottom of the well. The entire tool string is rotated so that drill bit 212 cuts borehole 14 of well 12 further. Drilling is performed in the usual manner for rotary rigs. Drilling fluid is pumped down central opening 274 through annular volume 276, open valve port 278 in upper circulating valve 266, lower portion 272 of longitudinal passage 270, sampling tube 232, lower circulating valve 236 and tube 213 to be discharged adjacent to drill bit 212. The fluid is circulated back up well annulus 225 in a conventional manner as well 12 is drilled. During the drilling operation, telemetry system 280 can send logging information to the surface with the mud pulser.

When the desired drilling has been carried out and apparatus 200 is on depth in the desired location, upper and lower circulating valves 266 and 236 are actuated to their second or formation evaluation positions. For example, if upper and lower circulating valves 266 and 236 are pressure actuated, a down link command is sent to the valves to actuate them to their second positions. As previously discussed, the actuation of upper circulating valve 266 closes valve port 278. The operation of upper and lower circulating valves 266 and 236 may be coordinated with the operation of packer control valve 228.

Fluid is then pumped down central opening 274 through opening 267 and annular volume 276, after which it passes through packer control valve 228 into inflation passage 222. Packer elements 206 and 208 are inflated to the position shown in FIG. 3B in which the packer elements are sealingly engaged with borehole 14 on opposite sides of formation 16 or at the desired locations in zone 16.

After packer elements 206 and 208 are inflated, packer control valve 228 closes to prevent over-inflation of the packer elements.

Thereafter, any additional fluid circulated down opening 267 and annular volume 276 will be forced through hydraulic motor 246, thus causing motor rotor 250 to rotate within motor stator 248. This results in pump rotor 244 being rotated within pump stator 242 as previously described. Fluid discharged from the lower end of motor 246 is exhausted into well annulus 225 after passing through annular cavity 254 and housing port 256 and subsequently circulated out of well 12.

As hydraulic motor 246 is thus actuated, pump 240 draws fluid from formation or zone 16 through sampling ports 238 and sampling tube 232. This fluid is discharged from pump 240 through annular cavity 254 and housing port 256 into well annulus 225. Pump 240 is actuated for a period of time in order to draw down zone 16. It is possible to control the formation or zone fluid production rate by controlling the circulating rate through central opening 274 from the surface. The pumping flow rate varies directly with the circulation rate since the circulated fluid is what drives hydraulic motor 246.

During this time, measurements of the physical properties of the fluid produced from zone 16 such as pressure, temperature, density, resistivity, conductivity, dielectric constant or other measureable physical fluid property can be used to determine if the fluid produced from zone 16 contains gas.

If gas is present in the fluid produced from zone 16, pumping performed on the zone of interest and the resulting commingling of fluid from the zone of interest with the mud in annulus portion 221 above packer 204 should be limited. This is necessary, because, as the commingled gas and mud circulate toward the surface, the gas in this mixture will expand. If a large quantity of gas is present in the fluid from zone 16, this may result in a significant decrease in the hydrostatic pressure of the column of fluid in annulus 225 and may result in a well control problem.

Measurements of the physical properties of the fluid produced from zone 16 can be sent to the surface in real time by telemetry system 280. With knowledge of these parameters, an operator at the surface may determine that gas is present and may stop or limit the operation of pump 240. Alternatively, apparatus 200 may further comprise sufficient downhole computer processing power to observe the physical properties of the fluid from zone 16, make the determination that gas is present, and transmit an alarm to the surface via telemetry system 280.

After a predetermined flow time or after determining that the draw-down of zone 16 is sufficient by observation of the real time data sent to the surface, one of samplers 234 may be activated in order to take a sample of the fluid in sampling tube 232. The operation of this sampler 234 may be initiated by modulating the mud pumps at the surface as a down-link command. Operation of any sampler 234 is optional.

It may be desired to measure formation or zone pressure using recorders 235 or 235' during one or more draw-down/build-up sequences at one depth while capturing one or more sample of formation fluid. Alternatively, the measure of zone pressures with recorders 235, 235' without capturing a sample may be desired.

After the measurements are taken, fluid circulation is halted, and the flow from zone 16 is stopped. This build-up phase is maintained for a period of time. Samples may be taken in additional samplers 234 and measurements recorded in additional recorders 235 during one of these draw-down/build-up sequences as previously mentioned.

Alternately, mud pumps at the surface can be used to send a command to apparatus 200 to stop formation pump 240 and start the build-up while maintaining circulation. During this phase of the test, real time build-up pressure is sent to the surface via telemetry. By observing the build-up pressure at the surface, an informed decision about when to end the build-up or test can be made.

Receptacle 262 also provides a means of connecting a secondary or inner well tool 282, which may be lowered to apparatus 200 through outer tubing string 202 until a stinger element 283 thereof is closely received within seal bore 264 of receptacle 262. This places inner well tool 282 in fluid communication with zone 16 through sampling tube 232 and longitudinal passage 270 by opening the closed valve 265 in receptacle 262. Inner well tool 282, like those in embodiments 10 and 100, may be dropped by gravity, pumped down, or conveyed on a slickline or wireline 284 or a coiled tubing string 286 or smaller joints of tubing or pipe, as seen in FIG. 3B.

Inner well tool 282 can be used to open valve 265 in receptacle 262 to make an isolated hydraulic connection between inner well tool 282 and formation 16. Potential inner well tools 282 which may be carried by gravity or pumped down include: wireline, coiled tubing or drill pipe retrievable samplers, wireline, coiled tubing or drill pipe retrievable electronic or mechanical pressure/temperature recorders; fluid chambers which may contain chemicals to be injected into zone 16; and a sub which simply opens receptacle 262 so that zone 16 may be in fluid communication with outer tubing string 202.

Potential inner well tools 282 which may be carried by coiled tubing or slick line include any of those listed above. Potential inner well tools 282 which may be carried by electric line include those listed above plus instruments for real time surface readout pressure/temperature and/or fluid properties.

Preferred embodiments of inner well tool 282 are the same as those described for inner well tools 78 and 172 of the first and second embodiments.

When the test is completed, tension is applied to outer tubing string 202 to release pressure from packer elements 206 and 208. This also releases pressure from all of apparatus 200 with the exception of any sampler 234, 234' which has been activated. Upper and lower circulating valves 266 and 236 are reset to their first or drilling positions so that apparatus 200 may again be rotated for further drilling operations or may be otherwise repositioned in well 12, and the operational sequence can be repeated several times if desired.

After completion of the final test, apparatus 200 is retrieved to the surface. There, samplers 234, 234' and recording instruments 235, 235' are removed from sampling chamber 230. Samplers 234, 234' may be drained on location, their contents may be transferred to sample bottles for shipment to a PVT laboratory, or the entire sampler 234, 234' may be shipped to a PVT laboratory for fluid transfer and testing.

During most of the run, real time data is sent to the surface via the pulser. However, the data rates obtainable with this technology are relatively slow, e.g., on the order of one to two bits per second. A much more detailed picture of what happened downhole during the test is available from analyzing data stored in apparatus 200 during the job.

The memory gauges and instruments 235, 235' can be read, and the pressure, temperature and resistivity data can be analyzed to determine formation pressure and temperature, permeability, and sample fluid resistivity. A change in sample fluid resistivity during each draw-down phase of the job would indicate that the mud filtrate was removed from zone 16 and that the fluid pumped through apparatus 200 near the end of the draw-down that was captured in the activated sampler 234, 234' is a representative fluid in the zone. A significant change in fluid temperature during the draw-downs would indicate that gas dissolved in the formation fluid came out of solution and flashed vapor during the draw-down and/or during sampling.

In the embodiment of apparatus 200 or 200' which includes the previously mentioned valve 233, a calculation of the bubble point of the well fluid may be carried out. With the apparatus positioned in wellbore 14 as shown in FIG. 3B, pump 240 is actuated in the manner previously described, and the pump is run long enough to get formation fluid inside sampling tube 232 and sampling chamber 230 (or in sampling tube 232' in embodiment 200'). With formation fluid thus inside the tool, valve 233 is closed to trap a volume of fluid between the valve and pump 240. Pump 240 is then operated to reduce the pressure of the trapped fluid sample. As the pressure is decreased inside the trapped volume of fluid, eventually the pressure will drop below the bubble point of the oil contained in the trapped volume of fluid. When the pressure drops below the bubble point, a phase change will occur in the sample as gas breaks out of solution. Pressure and temperature recording instruments 235 or 235' are used to detect the pressure at which the phase change occurs. Before the pressure falls below the bubble point, the pressure inside the sample will reduce sharply as the pump is run. When the pressure drops below the bubble point, the gas expansion in the sample will cause the pressure to drop much less sharply. This indicates the bubble point.

Alternate Formation Pump Embodiments

Figure 5:
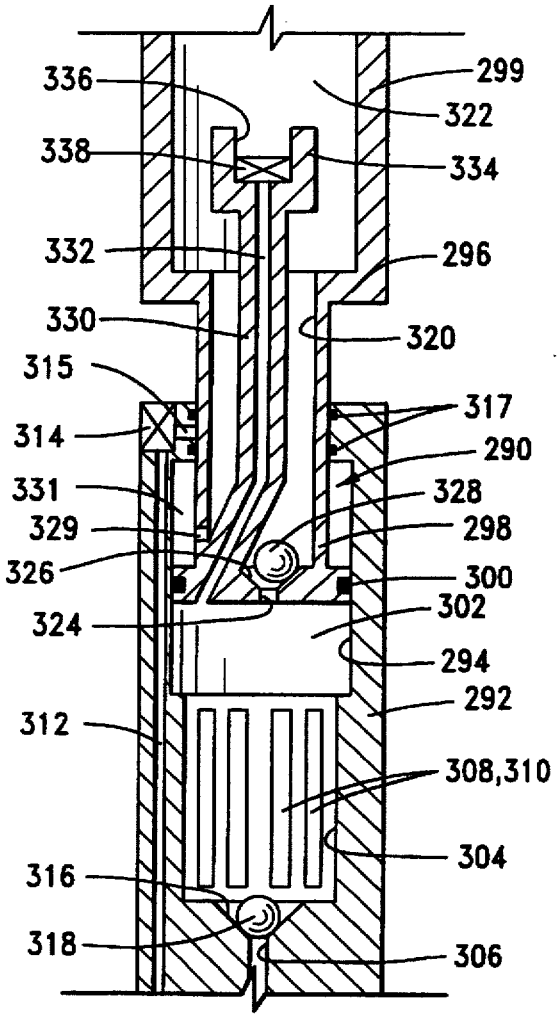
FIG. 5 illustrates an alternate embodiment using a reciprocating pump.
Figure 6:
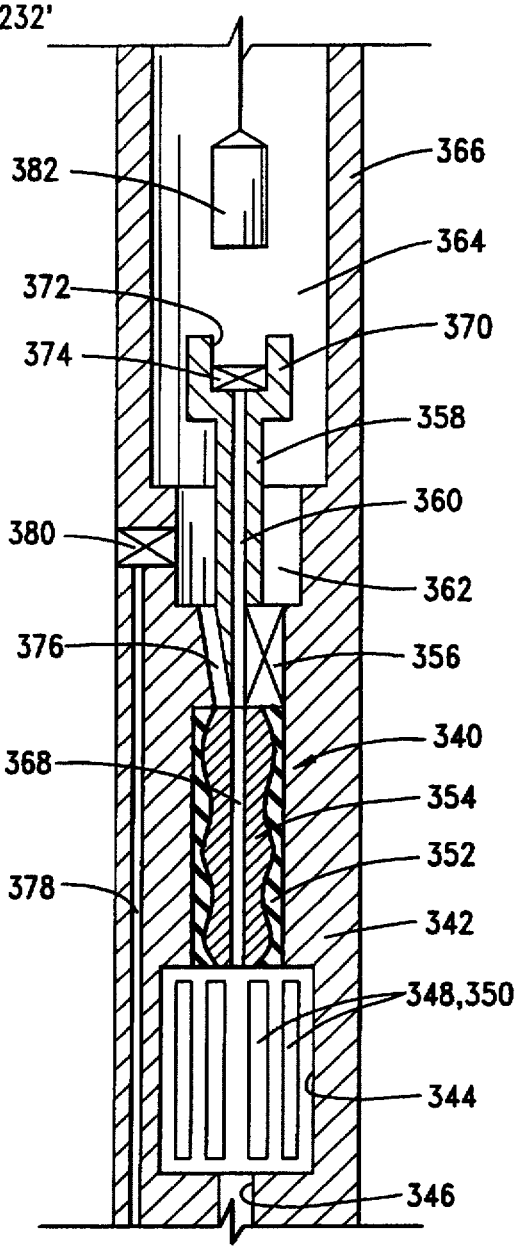
FIG. 6 shows an alternate embodiment with an electric driven pump.

Referring now to FIGS. 5–7, additional formation pump embodiments for the early evaluation system of the present invention will be discussed. In each of these embodiments, the pump is mechanically actuated as opposed to hydraulically actuated.

Referring now to FIG. 5, a reciprocating, plunger-type pump is shown and generally designated by the numeral 290. Pump 290 comprises a cylinder housing or portion 292 defining a cylinder bore 294 therein and a plunger housing or portion 296 having a plunger 298 extending downwardly therefrom. Plunger 298 is connected to an outer tubing string 299 and adapted for reciprocating movement within cylinder bore 294, and sealing engagement is provided therebetween by a sealing means 300. Those skilled in the art will thus see that a pumping chamber 302 is defined within cylinder bore 294 below plunger 298.

Cylinder housing 292 extends upwardly from a packer (not shown) similar or identical to those previously discussed, and the cylinder housing defines a sampling chamber 304 below, and in communication with pumping chamber 302. A sampling tube 306 extends from sampling chamber 304 to sampling ports between upper and lower packer elements, as previously described.

Disposed in sampling chamber 304 are a plurality of independently activated samplers 308 and any desired electronic or mechanical pressure and temperature recording instruments 310, also called recorders 310. Samplers 308 and recorders 310 are the same as those previously described and are used in the same or similar manner. Alternatively, the arrangement shown in FIG. 4 could be incorporated into this embodiment as well.

Cylinder housing 292 further defines an inflation passage 312 which is in communication with the inflatable elements of the packer. At the upper end of inflation passage 312 is a packer control valve 314 which allows inflation of the packer elements by pumping fluid down outer tubing string 299 as will be further described herein and preventing overpressure of the packer elements in the same manner as the earlier described embodiments.

Packer control valve 314 is in communication with a transverse port 315. A sealing means, such as a pair of seals 317 provide sealing engagement between cylinder housing 292 and plunger 298 on opposite sides of port 315.

An inlet valve seat 316 is located at the upper end of sampling tube 306, and an inlet valve 318 is disposed adjacent to the inlet valve seat. In the illustrated embodiment, inlet valve 318 is shown as a ball check valve 318 which allows fluid flow upwardly through sampling tube 306, but prevents downward flow therethrough. That is, when inlet valve 318 is closed, communication between sampling chamber 304 and sampling tube 306 is prevented, but when inlet valve 318 is open and moved upwardly with respect to inlet valve seat 316, there is fluid communication between sampling chamber 304 and sampling tube 306.

A plunger cavity 320 is defined in plunger 298 and is in communication with a central opening 322 in outer tubing string 299. An outlet port 324 is defined in the lower end of plunger 298 and is in communication with pumping chamber 302. Above outlet port 324, plunger 298 defines an outlet valve seat 326. An outlet valve 328 is positioned adjacent to outlet valve seat 326. Outlet valve' 328 is also illustrated as a ball check valve 328 which allows fluid flow upwardly through outlet port 324 while preventing fluid flow downwardly therethrough. That is, when outlet valve 328 is in a closed position, communication between plunger cavity 320 and outlet port 324 is prevented, and when outlet valve 328 is in an open position, as shown in FIG. 5, upward fluid flow from outlet port 324 into plunger cavity 320 is permitted.

A transverse port 329 is defined in plunger 298 and provides communication between plunger cavity 320 and plunger annulus 331. As will be further described herein, port 329 in plunger 298 is adapted for alignment with port 315 in cylinder housing 292 for packer inflation.

Extending through plunger 298 is an elongated tubular portion 330 which defines a passage 332 therethrough. The lower end of passage 332 is in communication with pumping chamber 302.

The upper end of passage 332 opens into a receptacle 334 which defines a seal bore 336 therein. A normally closed valve 338 is disposed in seal bore 336 and normally prevents communication between passage 332 and central opening 322 and outer tubing string 299.

The operation of the early evaluation system with pump 290 is similar to that of first embodiment apparatus 10 except that pump 290 is actuated by reciprocation of tubing string 299 rather than rotation thereof.

As the apparatus is lowered into the wellbore, the weight of the components from cylinder housing 292 downwardly will cause plunger 298 to be fully retracted with respect to cylinder housing 292. In this position, port 329 in plunger 298 is in alignment with port 315 in cylinder housing 292. Fluid may be pumped downwardly through aligned ports 329 and 315 and thus through packer control valve 314 and inflation passage 312 to inflate the packer.

In the pumping operation, when tubing string 299 is raised, plunger 298 is raised within cylinder bore 294. This draws fluid into pumping chamber 302 through inlet valve 318. During this upward movement, fluid pressure in central opening 322 of outer tubing string 299 and plunger cavity 320 in plunger 298 keeps outlet valve 328 closed.

After plunger 298 is fully raised, the tubing string is then lowered which, of course, results in lowering plunger 298. This reduces the volume of pumping chamber 302. Fluid in pumping chamber 302 is discharged through outlet valve 328 into plunger cavity 320. During this downward stroke, fluid is prevented from entering sampling tube 306 by closed inlet valve 318.

Thus, pump 290 draws fluid from the formation or zone of interest and discharges it into central opening 322 of outer tubing string 299. Pump 290 is actuated in this manner for a predetermined period of time in order to draw down the zone. The flow from the zone should displace fluid standing in central opening 322, and a good estimate of the production rate from the zone should be available by monitoring the flow rate at the surface. It is possible to control the production rate by varying the reciprocation of the tubing string at the surface. The rate of flow through pump 290 varies directly with the reciprocating speed of the tubing string .

An inner well tool (not shown) of the type previously described may be lowered into central opening 322 of outer tubing string 299 to engage receptacle 334 and thereby open valve 338. This places the inner tubing in communication with passage 332.

The remainder of the operation is similar to that previously described for the other embodiments.

Referring now to FIG. 6, another alternate embodiment pump is shown and generally designated by the numeral 340. Pump 340 is disposed in an upper housing 342 which is connected to a packer (not shown) in the manner previously described. Below pump 340, upper housing 342 defines a sampling chamber 344 and a sampling tube 346 therein. The construction of these portions may be the same as the previous embodiments described, including that in FIG. 4. That is, a plurality of samplers 348 and recorders 350 are in communication with sampling tube 346.

Pump 340, as illustrated, is again a rotary, progressive cavity pump having an elastomeric stator 352 and a rotor 354 rotatably disposed in the stator.

In formation pump 340, rotor 354 is connected to, and driven by, an electric motor 356. The connection between electric motor 356 and pump rotor 354 may be made in any manner known in the art, such as by a flexible shaft, coupling, transmission, etc.

An elongated tubular portion 358 defining a longitudinal passage 360 therein extends upwardly in upper housing 342 above electric motor 356. An annulus 362 is defined around a portion of tubular portion 358 and is in communication with a central opening 364 of an outer tubing string 366. Outer tubing string 366 is connected to, or forms a part of, upper housing 342.

The lower end of passage 360 is in communication with another passage 368 defined through pump rotor 354. Passage 368 opens into sampling chamber 344 and is in communication with sampling tube 346.

The upper end of passage 360 opens into a receptacle 370 which defines a seal bore 372 therein. A normally closed valve 374 is disposed in seal bore 372. When closed, valve 374 prevents communication between passage 360 and central opening 364.

An outlet port 376 is also defined in upper housing 342 and provides communication between a discharge side of pump 340 and annulus 362.

Also shown in FIG. 6 is an inflation passage 378 with a packer control valve 380 at the upper end thereof. Inflation passage 378 and packer control valve 380 are used in the same manner as in the other embodiments.

In operation, the early evaluation system utilizing pump 340 is lowered into the wellbore, and the packer is set in the manner previously described. When it is desired to flow fluid from the well formation or zone of interest, an electric line tool 382 is lowered into central opening 364 of outer tubing string 366 so that it engages seal bore 372 in receptacle 370. Electric line tool 382 may also be used to open valve 374 as desired.

Electric line tool 382 completes an electrical connection to electric motor 356 so that the electric motor can be energized to rotate pump rotor 354 within pump stator 352. Pump 340 thus draws fluid from the formation or zone of interest through sampling tube 346 in the previously described manner. This fluid is discharged from pump 340 through outlet port 376 into central opening 364 of outer tubing string 366. Pump 340 is operated in this manner for a predetermined period of time in order to draw down the zone. The flow from the zone should displace fluid standing in central opening 364 of outer tubing string 366, and a good estimate of the production rate from the zone and should be available by monitoring the flow rate at the surface. Electric motor 356 may be a variable speed motor so that it is possible to control the production rate by varying the speed of the electric motor. The rate of flow through pump 340 varies directly with the rotational speed of rotor 354.

The rest of the operation of the early evaluation system using pump 340 is carried out in the same manner previously described for the other embodiments.

Figure 7A:
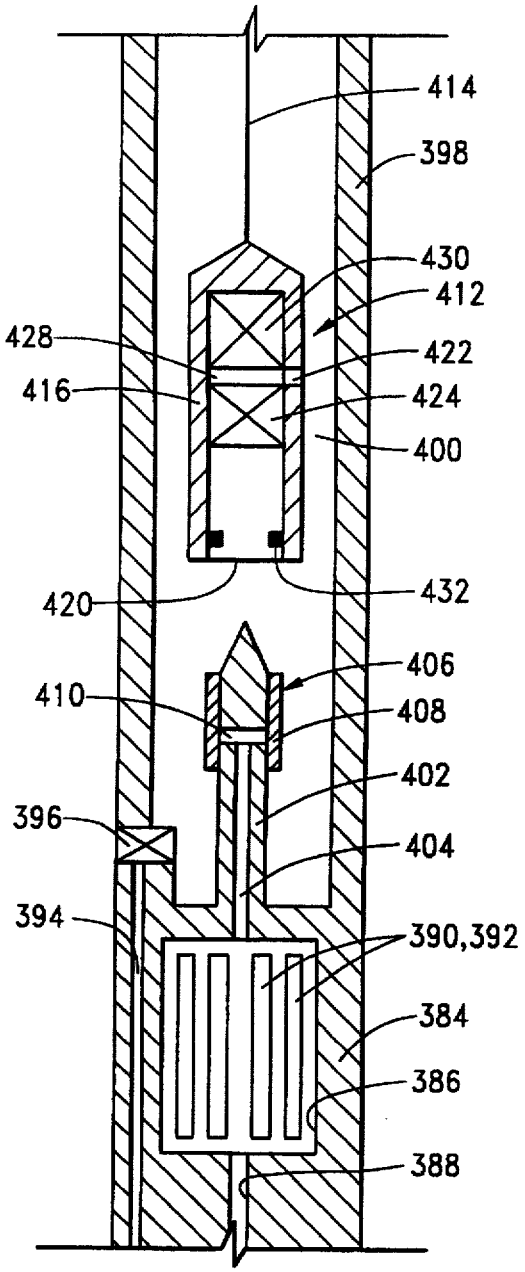
FIGS. 7A and 7B illustrate an alternate embodiment in which a pump is lowered on a wireline.
Figure 7B:
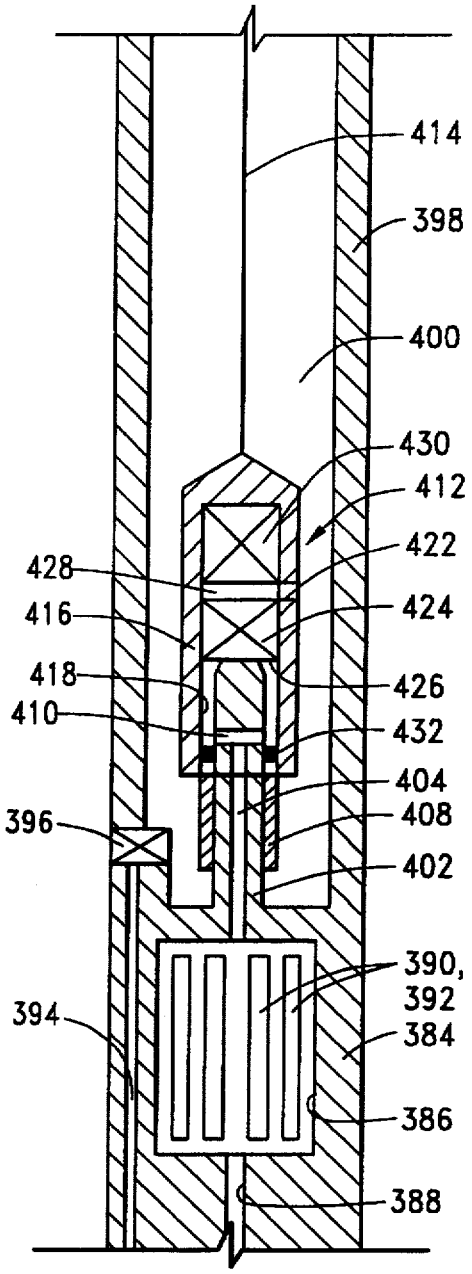

Referring now to FIGS. 7A and 7B, a further alternate pump embodiment is shown. In this embodiment, the pump is not located in a housing portion of the apparatus, but rather is lowered on a wireline to be engaged with a receptacle.

In this embodiment, the apparatus includes an upper housing 384 defining a sampling chamber 386 and a sampling tube 388 therein. As with the other embodiments, a plurality of samplers 390 and recorders 392 may be disposed in the apparatus and placed in communication with sampling tube 388. The embodiment of FIG. 4 may also be used.

Upper housing 384 also defines an inflation passage 394 and has a packer control valve 396 disposed therein. Packer control valve 396 and inflation passage 394 are used in the previously described manner to inflate an inflatable packer (not shown) attached to upper housing 384.

An outer tubing string 398 forms an upper portion of, or is a separate component attached to, upper housing 384. Outer tubing string 398 defines a central opening 400 therein. Packer control valve 396 is in communication with central opening 400.

A tubular portion 402 extends upwardly in central opening 400 and defines a passage 404 therein. Passage 404 is in communication with sampling chamber 386 and sampling tube 388.

At the upper end of tubular portion 402 is a receptacle. Receptacle 406, as illustrated in FIG. 7A, has a sliding valve sleeve 408 which normally covers a transverse port 410. Transverse port 410 is in communication with passage 404 in tubular portion 402.

A special wireline tool 412 may be lowered on a wireline 414 as seen in FIG. 7A. Wireline tool 412 includes a housing 416 defining a cavity 418 therein. Housing 416 has an open lower end 420. Housing 416 further defines a housing port 422 therein which provides communication between cavity 416 and central opening 400.

Disposed in cavity 418 of housing 416 below housing port 422 is an electric pump 424 which has a downwardly facing inlet side 426 and an upwardly facing discharge side 428 in communication with housing port 422.

An array of samplers and sensors 430 may also be disposed in housing 416 of wireline tool 412.

In operation, the packer is set in the previously described manner, and wireline tool 412 is lowered into engagement with receptacle 406 as seen in FIG. 7B. Housing 416 fits over receptacle 406 so that a portion thereof extends into cavity 418. Valve sleeve 408 is moved downwardly to an open position in which transverse port 410 is uncovered and placed in communication with cavity 418 and housing 416. Thus, it will be seen that pump inlet 426 is in communication with sampling chamber 386 and sampling tube 388 through cavity 418, port 410 and passage 404. A sealing means 432 may be used to provide sealing engagement between housing 416 and tubular portion 402 below transverse port 410 when valve sleeve 408 is in the open position shown in FIG. 7B.

After this positioning of wireline tool 412, pump 424 is operated to draw fluid from the formation or zone of interest through sampling tube 388. This fluid is discharged from pump 424 through port 422 into central opening 400 of outer tubing string 398. Pump 424 is operated in this manner for a period of time in order to draw down the zone. The flow from the zone should displace fluid standing in central opening 400, and a good estimate of the production rate from the zone should be available by monitoring the flow rate at the surface. If electric pump 424 has a variable speed, the production rate may be controlled by varying the speed of the pump at the surface. The rate of flow through pump 424 would then vary directly with the speed thereof.

The array of samplers and sensors 430 may be used to provide an indication at the surface of the position of wireline tool 412. Also, additional samples and measurements may be taken utilizing such an array as previously known in the art.

The rest of the operation of the apparatus shown in FIGS. 7A and 7B is in the same manner as the previous embodiments described earlier.

In any of the embodiments of FIGS. 5, 6, 7A and 7B, a valve similar to valves 51, 135 or 233 may be positioned in the corresponding sampling tube. Such a normally opened valve could then be closed as desired to perform a bubble point calculation as previously described for the other embodiments.

It will be seen, therefore, that the early evaluation system with pump of the present invention is well adapted to carry out the ends and advantages mentioned, as well as those inherent therein. While presently preferred embodiments of the apparatus have been shown for the purposes of this disclosure, numerous changes in the arrangement and construction of parts may be made by those skilled in the art. All such changes are incorporated within the scope and spirit of the appended claims.

What is claimed is:

1. An apparatus for use in servicing a well having an uncased borehole intersecting a subsurface zone of interest, said apparatus comprising:

an outer tubing string;

a housing adjacent to said outer tubing string and having a sampling tube therein;

a packer adjacent to said housing and adapted for sealing the borehole on a side of the zone; and a formation pump in communication with said sampling tube for flowing fluid from said zone through said sampling tube;

wherein, said outer tubing string is adapted for running into the uncased borehole and positioning said housing, packer and pump in a desired location with respect to the zone.

2. The apparatus of claim 1 wherein said pump is mechanically actuated.

3. The apparatus of claim 2 wherein:

a shaft of said pump is connected to said outer tubing string; and said outer tubing string is rotatable with respect to said housing.

4. The apparatus of claim 2 wherein said pump is a progressive cavity pump comprising an elastomeric stator and a rotor rotatably disposed in said stator.

5. The apparatus of claim 2 wherein said pump is driven by an electric motor.

6. The apparatus of claim 5 wherein said pump and electric motor are positionable in said outer tubing string on a wireline.

7. The apparatus of claim 1 wherein said pump is hydraulically actuated.

8. The apparatus of claim 7 further comprising:

a hydraulic motor connected to said pump; and wherein, said hydraulic motor is actuated in response to fluid pumped down said outer tubing string.

9. The apparatus of claim 8 wherein said hydraulic motor is a progressive cavity device comprising an elastomeric motor stator and a motor rotor rotatably disposed in said motor stator.

10. The apparatus of claim 8 wherein said pump is a progressive cavity device comprising an elastomeric pump stator and a pump rotor rotatably disposed in said pump stator.

11. The apparatus of claim 8 wherein said housing defines a housing port therein whereby fluid discharged from said hydraulic motor and pump may be exhausted from said housing.

12. The apparatus of claim 1 wherein fluid discharged from said pump may be pumped into said outer tubing string.

13. The apparatus of claim 1 further comprising a sampler in communication with said sampling tube whereby a fluid sample may be retained.

14. The apparatus of claim 1 further comprising a recording instrument in communication with said sampling tube whereby at least one characteristic of fluid from said formation may be measured.

15. The apparatus of claim 1 further comprising a telemetry system disposed in said housing whereby measured fluid data from the apparatus may be sent to the surface.

16. The apparatus of claim 1 wherein said packer is an inflatable packer.

17. The apparatus of claim 16 wherein said packer is a straddle packer having a pair of inflatable packer elements for sealing the wellbore on opposite sides of the zone.

18. The apparatus of claim 17 further comprising equalizing means for equalizing pressure on opposite sides of said packer elements when said straddle packer is engaged with the wellbore.

19. The apparatus of claim 1 further comprising a valve disposed in said sampling tube.

20. The apparatus of claim 19 wherein said valve is a normally opened valve and is positioned between said packer and said pump.

21. An apparatus for use in drilling and servicing a well adjacent to a subsurface zone of interest in the well, said apparatus comprising:

an outer tubing string;

a housing adjacent to said outer tubing string and having a sampling tube therein;

a drill bit disposed below said housing; and a pump in communication with said sampling tube for flowing fluid from said zone through said sampling tube.

22. The apparatus of claim 21 further comprising a packer adjacent to said housing and adapted for sealing a borehole of said well after drilling thereof with said drill bit.

23. The apparatus of claim 21 wherein said pump is hydraulically actuated.

24. The pump of claim 21 further comprising:

a hydraulic motor connected to said pump; and wherein, said hydraulic motor is actuated in response to fluid pumped down said outer tubing string.

25. The apparatus of claim 24 wherein said hydraulic motor is a progressive cavity device comprising an elastomeric motor stator and a motor rotor rotatably disposed in said rotor stator.

26. The apparatus of claim 23 wherein said pump is a progressive cavity device comprising an elastomeric pump stator and a pump rotor rotatably disposed in said pump stator.

27. The apparatus of claim 23 further comprising means for selectively flowing fluid down said tubing string to said drill bit during a drilling operation and toward said pump for actuation thereof during a sampling operation.

28. The apparatus of claim 27 wherein said means for selectively flowing comprises:

an upper circulating valve having a first position wherein said outer tubing string is in communication with a longitudinal passage defined at least partially within said pump and a second position wherein said outer tubing string is isolated from said longitudinal passage; and a lower circulating valve having a first position wherein said sampling tube is in communication with said drill bit and isolated from the zone of interest and a second position wherein said sampling tube is in communication with said zone of interest and isolated from said drill bit;

wherein:

when said upper and lower circulating valves are in said first positions thereof, drilling fluid pumped down said outer tubing string is discharged adjacent to said drill bit; and when said upper and lower circulating valves are in said second positions thereof, said pump may be actuated for flowing fluid from said zone of interest into said sampling tube.

29. The apparatus of claim 28 wherein said upper and lower circulating valves are pressure actuated.

30. A method of servicing a well having an uncased borehole intersecting a subsurface zone or formation of interest, comprising:

(a) running an evaluation tool into said well, said evaluation tool comprising:

an outer tubing string on which said evaluation tool is run into said well;

a housing adjacent to said outer tubing string and having a sampling tube therein;

a packer connected to said housing;

a communication passage communicating said sampling tube with said borehole below said packer; and a formation pump in communication with said sampling tube;

(b) setting said packer in said borehole adjacent to said subsurface zone or formation; and (c) after step (b), actuating said pump so that fluid is flowed from said zone below said packer into said borehole and through said communication passage and said sampling tube.

31. The method of claim 30 wherein said packer comprises an inflatable packer element.

32. The method of claim 31 wherein:

said evaluation tool further comprises:

an inflation passage communicating said inflatable packer element with an interior of said outer tubing string; and an inflation valve having an open position wherein said inflation passage is open, and having a closed position wherein said inflation passage is closed;

step (b) includes, with said inflation valve in said open position, inflating said inflatable packer element by increasing fluid pressure in said interior of said outer tubing string; and after step (b), closing said inflation valve to maintain said packer in said borehole.

33. The method of claim 30, wherein:

in step (a), said packer is a straddle packer having upper and lower packer elements; and in step (b), said upper and lower packer elements are respectively set above and below at least a portion of said subsurface zone or formation.

34. The method of claim 30 further comprising:

(d) trapping a fluid sample in a sampler in communication with said sampling tube.

35. The method of claim 34 further comprising repeating step (d) as necessary to trap additional well fluid samples.

36. The method of claim 30 wherein:

said pump is mechanically actuated; and step (c) comprises rotating said outer tubing string with respect to said housing and thereby actuating said pump.

37. The method of claim 30 wherein:

said pump is hydraulically actuated;

said evaluation tool further comprises a hydraulic motor connected to said pump; and step (c) comprises pumping fluid down said outer tubing string to activate said hydraulic motor and thereby actuate said pump.

38. The method of claim 30 further comprising:

(d) recording a fluid characteristic of fluid flowed.

39. The method of claim 30 further comprising:

(d) transmitting fluid data from a telemetry system positioned in said evaluation tool.

40. The method of claim 30 further comprising:

(d) after step (c), closing a valve in said sampling tube; and (e) after step (d), actuating said pump to reduce pressure of fluid between said pump and said valve such that the pressure eventually drops below the bubble point of oil contained in the fluid and a phase change occurs.

41. The method of claim 40 further comprising:

(f) measuring the pressure of the fluid before and after the phase change to determine said bubble point.

42. The method of claim 41 further comprising:

(f) measuring the temperature of the fluid before and after the phase change to determine said bubble point.

43. A method of drilling and servicing a well comprising:

(a) positioning a drill string in said well, said drill string comprising:

a drill bit;

a packer connected to said drill bit, said packer defining a sampling port therein;

a housing attached to said packer and having a sampling tube therein;

a formation pump disposed in said housing and in communication with said sampling tube; and an outer tubing string disposed above said housing;

(b) drilling at least a portion of a borehole of said well by rotation of said drill string such that said borehole intersects a subsurface zone of interest;

(c) during step (b), circulating fluid down said outer tubing string to said drill bit;

(d) stopping rotation of said drill string;

(e) actuating said packer into sealing engagement adjacent to said subsurface zone; and (f) actuating said pump so that fluid is flowed from said subsurface zone through said sampling port into said sampling tube.

44. The method of claim 43 further comprising:

(g) trapping a fluid sample in a sampler in communication with said sampling tube.

45. The method of claim 44 further comprising repeating step (g) to trap additional well fluid samples.

46. The method of claim 43 wherein:

said drill string further comprises:

a first circulating valve having a first position wherein said sampling tube is in communication with said drill bit and isolated from said sampling port and a second position wherein said sampling tube is in communication with said sampling port and isolated from said drill bit; and a second circulating valve having a first position wherein said outer tubing string is in communication with said sampling tube and a second position wherein said outer tubing string is isolated from said sampling tube;

step (c) is carried out with said first and second circulating valves in said first positions thereof; and step (f) is carried out with said first and second circulating valves in said second positions thereof.

47. The method of claim 43 wherein:

said pump is hydraulically actuated;

said drill string further comprises a hydraulic motor connected to said pump; and step (f) comprises pumping fluids down said outer tubing string to activate said hydraulic motor and thereby actuate said pump.

48. The method of claim 47 wherein step (f) further comprises exhausting fluid discharged from said motor and said pump into a well annulus adjacent to said drill string.

49. The method of claim 43 further comprising:

(g) recording a fluid characteristic of fluid flowed into said sampling tube.

50. The method of claim 43 further comprising:

(g) transmitting fluid data from a telemetry system positioned in said drill string.

51. The method of claim 43 further comprising:

(g) running an inner well tool into said outer tubing string; and (h) engaging said inner well tool with said outer tubing string and placing said inner well tool in fluid communication with said subsurface zone through said sampling port.

52. The method of claim 51 further comprising:

(i) after step (h), flowing a fluid sample from said subsurface zone through said sampling port and sampling tube to said inner well tool.

53. The method of claim 51 further comprising:

(i) after step (h), stimulating said well by flowing fluid from said inner well tool through said sampling tube and sampling port to said subsurface zone.

54. The method of claim 43 further comprising:

(g) disengaging said packer from sealing engagement; and (h) repeating steps (b) through (f).

55. The method of claim 43 wherein:

said pump is mechanically actuated; and step (f) comprises rotating said outer tubing string and thereby actuating said pump.

56. The method of claim 43 wherein:

said pump is mechanically actuated; and step (f) comprises reciprocating said outer tubing string and thereby actuating said pump.

57. The method of claim 43 further comprising:

(g) after step (f), closing a valve in said sampling tube; and (h) after step (g), actuating said pump to reduce pressure of fluid between said pump and said valve such that the pressure eventually drops below the bubble point of oil contained in the fluid and a phase change occurs.

58. The method of claim 57 further comprising:

(i) measuring the pressure of the fluid before and after the phase change to determine said bubble point.

59. The method of claim 57 further comprising:

(i) measuring the temperature of the fluid before and after the phase change to determine said bubble point.

60. A method of servicing a well and performing a bubble point determination in a wellbore intersecting a subsurface zone or formation of interest, comprising:

(a) running an evaluation tool into said well, said evaluation tool comprising:

an outer tubing string on which said evaluation tool is run into said well;

a housing adjacent to said outer tubing string and having a sampling tube therein;

a valve disposed in said sampling tube;

a communication passage communicating said sampling tube with said wellbore; and a formation pump in communication with said sampling tube;

(b) actuating said pump so that fluid is flowed from said zone into said wellbore and through said communication passage and sampling tube;

(c) after step (b), closing said valve; and (d) after step (c), actuating said pump to reduce the pressure of fluid between said pump and said valve.

61. The method of claim 60 wherein:

step (d) comprises reducing said pressure until said pressure drops below the bubble point of oil contained in the fluid such that a phase change occurs as gas breaks out of solution.

62. The method of claim 61 wherein:

said evaluation tool further comprises a pressure measuring instrument in communication with said sampling tube; and further comprising (e) using said instrument to detect the pressure at which said phase change occurs.

63. The method of claim 61 wherein:

said evaluation tool further comprises a temperature measuring instrument in communication with said sampling tube; and further comprising (e) using said instrument to detect the temperature at which said phase change occurs.

64. The method of claim 60 wherein:

said evaluation tool further comprises a packer connected to said housing, said communication passage being below said packer and said valve being between said packer and said pump; and further comprising the step of setting said packer adjacent to said subsurface zone formation prior to step (b).

65. The method of claim 64 wherein:

said packer is a straddle packer having upper and lower packer elements; and said upper and lower packer elements are respectively set above and below at least a portion of said subsurface zone or formation.

66. An apparatus for use in servicing a well having an uncased borehole intersecting a subsurface zone of interest, said apparatus comprising:

an outer tubing string;

a housing adjacent to said outer tube string and having a sampling tube therein;

a packer adjacent to said housing and adapted for sealing the borehole on a side of the zone;

a formation pump in communication with said sampling tube for flowing fluid from said zone through said sampling tube; and a drill bit connected to a lower end of said packer.

67. The apparatus of claim 66 further comprising:

said housing defining a sampling port therein;

an upper circulating valve having a first position wherein said outer tubing string is in communication with said sampling tube and a second position wherein said outer tubing string is isolated from said sampling tube; and a lower circulating valve having a first position wherein said sampling tube is in communication with said drill bit and isolated from said sampling port and a second position wherein said sampling tube is in communication with said sampling port and isolated from said drill bit;

wherein:

when said upper and lower circulating valves are in said first positions thereof, drilling fluid pumped down said outer tubing string is discharged adjacent to said drill bit; and when said upper and lower circulating valves are in said second positions thereof, said pump may be actuated for flowing fluid from said zone through said sampling port into said sampling tube.

68. The apparatus of claim 67 wherein said upper and lower circulating valves are pressure actuated.

69. An apparatus for use in servicing a well having an uncased borehole intersecting a subsurface zone of interest, said apparatus comprising:

an outer tubing string;

a housing adjacent to said outer tubing string and having a sampling tube therein;

a packer adjacent to said housing and adapted for sealing the borehole on a side of the zone; and a formation pump in communication with said sampling tube for flowing fluid from said zone through said sampling tube, said pump being mechanically actuated and comprising:

a cylinder portion forming a portion of said housing; and a plunger portion slidably disposed in said cylinder portion and connected to said outer tubing string;

wherein, said outer tubing string is reciprocable with respect to said cylinder portion.

70. The apparatus of claim 55 further comprising sealing means for sealing between said plunger portion and said cylinder portion.

71. The apparatus of claim 55 wherein said pump further comprises:

an inlet valve having an open position allowing fluid communication between said sampling tube and a pumping chamber defined by said cylinder portion and said plunger portion and a closed position; and an outlet valve having an open position allowing communication between said pumping chamber and a central opening of said outer tubing string and a closed position.

72. A method of servicing a well having an uncased borehole intersecting a subsurface zone on formation of interest, comprising:

(a) running an evaluation tool into said well, said evaluation tool comprising:

an outer tubing string;

a housing adjacent to said outer tubing string and having a sampling tube therein;

a packer connected to said housing;

a communication passage communicating said sampling tube with said borehole below said packer;

a formation pump in communication with said sampling tube, said pump being hydraulically actuated; and a hydraulic motor connected to said pump;

(b) setting packer in said borehole adjacent to said subsurface zone or formation; and (c) after step (b), actuating said pump so that fluid is flowed from said zone below said packer into said borehole and through said communication passage and sampling tube, said actuating comprising:

pumping fluid down said outer tubing string to activate said hydraulic motor and thereby actuate said pump; and exhausting fluid discharged from said motor and said pump into a well annulus adjacent to said evaluation tool.

73. A method of servicing a well having an uncased borehole intersecting a subsurface zone or formation of interest, comprising:

(a) running an evaluation tool into said well, said evaluation tool comprising:

an outer tubing string;

a housing adjacent to said outer tubing string and having a sampling tube therein;

a packer connected to said housing;

a communication passage communicating said sampling tube with said borehole below said packer;

a formation pump in communication with said sampling tube; and a drill bit attached to a lower end of said packer;

(b) drilling at least a portion of a borehole of said well with said drill bit by rotation of said outer tubing string;

(c) setting said packer in said borehole adjacent to said subsurface zone or formation; and (d) after step (c), actuating said pump so that fluid is flowed from said zone below said packer into said borehole and through said communication passage and said sampling tube.

74. The method of claim 73 wherein:

said evaluation tool further comprises:

an upper circulating valve having a first position wherein said outer tubing string is in communication with said sampling tube, and having a second position wherein said outer tubing string is isolated from said sampling tube; and a lower circulating valve having a first position wherein said sampling tube is in communication with said drill bit and isolated from said borehole and a second position wherein said sampling tube is in communication with said borehole and isolated from said drill bit;

step (b) is carried out when said upper and lower circulating valves are in said first positions thereof; and step (d) is carried out when said upper and lower circulating valves are in said second positions thereof.

75. The method of claim 74 wherein said upper and lower circulating valves may be actuated between said first and second positions thereof by pressure transmitted through said outer tubing string.

76. A method of servicing a well having an uncased borehole intersecting a subsurface zone or formation of interest, comprising:

(a) running an evaluation tool into said well, said evaluation tool comprising:
an outer tubing string;
a housing adjacent to said outer tubing string and having a sampling tube therein;
a packer connected to said housing;
a communication passage communicating said sampling tube with said borehole below said packer; and
a formation pump in communication with said sampling tube;

(b) setting said packer in said borehole adjacent to said subsurface zone or formation;

(c) after step (b), actuating said pump so that fluid is flowed from said zone below said packer into said borehole and through said communication passage and said sampling tube;

(d) running an inner well tool into said outer tubing string; and (e) engaging said inner well tool with said outer tubing string and placing said inner well tool in fluid communication with said zone through said communication passage.

77. The method of claim 76 further comprising:

(f) after step (e), flowing a fluid sample from said zone through said communication passage to said inner well tool.

78. The method of claim 76 further comprising:

(f) after step (e), stimulating said zone by flowing fluid from said inner well tool through said communication passage to said zone.

79. A method of servicing a well having an uncased borehole intersecting a subsurface zone or formation of interest, comprising:

(a) running an evaluation tool into said well, said evaluation tool comprising:
an outer tubing string;
a housing adjacent to said outer tubing string and having a sampling tube therein;
a packer connected to said housing;
a communication passage communicating said sampling tube with said borehole below said packer; and
a formation pump in communication with said sampling tube, said pump being mechanically actuated;

(b) setting said packer in said borehole adjacent to said subsurface zone or formation; and (c) after step (b), actuating said pump by reciprocating said outer tubing string so that fluid is flowed from said zone below said packer into said borehole and through said communication passage and said sampling tube.

* * * * *